US010925334B1

(12) United States Patent
Husser

(10) Patent No.: US 10,925,334 B1
(45) Date of Patent: Feb. 23, 2021

(54) GLOVE OR HANDWEAR CLOSURE AND TIGHTENING SYSTEM FOR IMPROVED FIT TO A USER'S HAND

(71) Applicant: Nicholas Adam Husser, Brunswick, OH (US)

(72) Inventor: Nicholas Adam Husser, Brunswick, OH (US)

( * ) Notice: Subject to any disclaimer, the term of this patent is extended or adjusted under 35 U.S.C. 154(b) by 104 days.

(21) Appl. No.: 16/153,687

(22) Filed: Oct. 5, 2018

(51) Int. Cl.
*A41D 19/00* (2006.01)

(52) U.S. Cl.
CPC ..... *A41D 19/0034* (2013.01); *A41D 19/0048* (2013.01); *A41D 2300/32* (2013.01); *A41D 2300/324* (2013.01); *A41D 2300/33* (2013.01)

(58) Field of Classification Search
CPC ..... A41D 19/0034; A41D 19/0048; A41D 2300/32; A41D 2300/33; A41D 2300/324; A41D 19/01582
See application file for complete search history.

(56) References Cited

U.S. PATENT DOCUMENTS 1,106,708 A 8/1914 Hazard
2,325,482 A 7/1943 Curran
3,372,401 A 3/1968 Woodward
3,504,379 A 4/1970 Glick
3,588,917 A 6/1971 Antonious
3,952,333 A * 4/1976 Fujita ..... A63B 71/146 2/161.5
4,042,977 A 8/1977 Antonious
4,691,388 A 9/1987 Boone
5,195,188 A 3/1993 Bourdeau et al.
5,740,555 A 4/1998 Renegar
6,119,267 A * 9/2000 Pozzi ..... A41D 13/088 2/161.1
6,418,560 B1 * 7/2002 Emechete ..... A41D 19/01505 2/159
8,353,088 B2 1/2013 Ha
8,434,200 B2 5/2013 Chen
8,458,816 B2 6/2013 Litke
8,646,113 B2 2/2014 Clement et al.

* cited by examiner

*Primary Examiner* — Michael McCullough

(57) ABSTRACT

The present invention relates to handwear or a glove to be worn on a user's hand. More particularly, the present invention relates to methods, systems, devices, and mechanisms for securing handwear or a glove to a user's hand. Even more particularly, the present invention relates to methods, systems, devices and mechanisms to create a custom fit of the handwear or glove to the user's hand in multiple dimensions or directions. The invention further relates to various types of fasteners and configurations adapted to create a multiple-dimension or multiple-direction custom fit securing the handwear or glove to the user's hand.

20 Claims, 14 Drawing Sheets

GLOVE OR HANDWEAR CLOSURE AND TIGHTENING SYSTEM FOR IMPROVED FIT TO A USER'S HAND

BACKGROUND OF THE INVENTION

1. Field of the Invention

The present invention relates to handwear or a glove to be worn on a user's hand. More particularly, the present invention relates to methods, systems, devices, and mechanisms for securing handwear or a glove to a user's hand. Even more particularly, the present invention relates to methods, systems, devices and mechanisms to create a custom fit of the handwear or glove to the user's hand in multiple dimensions or directions. The invention further relates to various types of fasteners and configurations adapted to create a multiple-dimension or multiple-direction custom fit securing the handwear or glove to the user's hand.

2. Technical Background

The purpose of wearing a sport glove is to enhance the hand's natural abilities to grip and have strength. The ideal glove should not restrict or decrease the hands abilities in anyway. Most current gloves attach to the hand by tightening around the wrist in order to help keep the glove secure to the hand and fingers. However, this often restricts the movement of the wrist when tightened and therefore restricts the range of motion of the user's hand. Other gloves are strapped tight across the back of the hand taking pressure off the wrist, but this generally does not keep the glove tight on the fingers and therefore requires constant adjusting or pulling on the glove in order to feel like the glove is on or fits properly. Also pulling the glove tight across the back of the hand pulls the material tight across the palm which causes the material to pull away from the palm as the glove is tightened. Many athletes resort to buying a smaller sized glove and do not utilize the strap just so that they feel a constant snug fit on the fingers and palm without the issues current straps present. However, a smaller-sized glove can restrict movement, and typically results in flaps or straps hanging out and moving freely which poses numerous problems in different sports, including the distraction of the movement of the straps or flaps and hindrance of the user's intended movements and actions.

In light of the drawbacks to traditional gloves and their closure and tightening systems, it is an object of the present invention to provide improved fit of gloves and handwear. It is a further object of the present invention to provide securely fitting gloves and handwear in multiple positions and planes of the user's hand. It is still further an object of the present invention to provide several alternative glove and handwear closure and tightening systems that address the fit of the glove or handwear to the user's entire hand in multiple directions and dimensions. Even further still, it is another object of the objective of the present invention is to provide a constant customized fit to the user's entire hand without restricting movement or motion of the user's hand and wrist when the hand is used in multiple directions.

SUMMARY OF THE INVENTION

The present invention relates to handwear or a glove to be worn on a user's hand. More particularly, the present invention relates to methods, systems, devices, and mechanisms for securing handwear or a glove to a user's hand. Even more particularly, the present invention relates to methods, systems, devices and mechanisms to create a custom fit of the handwear or glove to the user's hand in multiple dimensions or directions. The invention further relates to various types of fasteners and configurations adapted to create a multiple-dimension or multiple-direction custom fit securing the handwear or glove to the user's hand.

When describing the invention medical terms will be used to specify location and direction. Medial refers to being toward the midline of the body, and lateral refers to a location that is away from the middle of the body. Proximal refers to something closer to the torso while distal refers to something that is further away from the torso. Dorsal is used to describe the back of the hand and volar (or palmar) is used to describe the palm or front of the hand. References to such medical terms and the planes of the human body are all made in reference to the user in a normal orientation and position, such as standing with his or her arms extended down parallel to his or her body, or similar to the Vitruvian Man. Such positional reference is not intended to be limiting with respect to the user's position and orientation, but merely as a base of reference for the medical terms and planes of orientation, and to make it clear that all descriptions of planes and orientation are normalized to a standard position, rather than dynamically changing with changing positions during an activity, which may result in extreme rotations and angular changes. Thus, for example, reference to a medial plane or position always refers to medial as if the user were standing in the normal position, and not dynamically changing with the orientation of and position of the user's hand such as during the course of a golf swing or a football player leaping to make a catch.

Many embodiments of the present invention comprise at least one connecting strap that wraps around the user's hand from the volar side of the glove to the dorsal side. Preferably at least two such straps are used, at least one such strap on the medial side and at least one such strap on the lateral side of the user's hand. Preferably, these straps start or are attached to the glove or handwear on the proximal volar side of the hand and wrap around the base of the $1^{st}$ and $5^{th}$ metacarpals to then attach on the dorsal side of the hand. This provides multiple directions of tension while the hand flexes, extends, radially deviates and ulnarly deviates, all while minimizing or eliminating restriction of movement of the wrist and hand.

The connecting straps are preferably attached to, affixed to, or integrated into the glove or handwear at a common strap connection point. Preferably, the common strap connection point is on the palmar or volar side of the glove or handwear. The connecting straps may be attached removably or permanently or affixed to the common strap connecting point in any manner known to those skilled in the art, including, but not limited to, sewing or stitching, buttons, snap connectors, rivets, glue, or the like. Alternatively, the connecting straps may be integrated into the glove or handwear such that they are continuations or extensions of the material used to make up the glove or handwear. The common strap connecting point may be a single point on the volar side of the glove or handwear to which all connecting straps are affixed, attached, or originate from. However, the common strap connecting point may be a larger area or region from which one or two which the connecting straps generally originate or are attached or affixed. Preferably, the common strap connecting point is comprises an area of 20 $cm^2$. More preferably, the common strap connecting point comprises an area of 15 $cm^2$. Still more preferably, the common strap connecting point comprises an area of 13

$cm^2$. Yet more preferably, the common strap connecting point comprises an area of 10 $cm^2$. Even more preferably, the common strap connecting point comprises an area of 7 $cm^2$. Still yet more preferably, the common strap connecting point comprises an area of 5 $cm^2$. Yet even more preferably, the common strap connecting point comprises an area of 3 $cm^2$. Even still more preferably, the common strap connecting point comprises an area of 1 $cm^2$. Yet still more preferably, the common strap connecting point comprises an area of 0.5 $cm^2$. Still even more preferably, the common strap connecting point comprises an area of 0.1 $cm^2$. Even yet more preferably, the common strap connecting point comprises a single point or the connecting straps originate from the same location on the volar side of the glove or handwear.

Some embodiments of the present invention may include a glove or handwear tongue. The tongue is similar to the tongue of a shoe, both in design (in many embodiments) and function. The tongue may be a separate element attached or affixed to the glove via any method known in the art (e.g., sewing, buttons, stitching, and the like), or may be an integrated piece of the glove or handwear. For an integrated tongue, the tongue may be formed by a pair of slits cut or otherwise manufactured in the dorsal side of the glove or handwear that effectively creates a separate flap that operates as the tongue. The tongue of such embodiments creates flexibility and looseness in the unfastened or secured glove or handwear which significantly increases the ease of donning and doffing the glove or handwear. Additionally, when the glove or handwear is on the user's hand, the tongue operates to seal the glove or handwear on the dorsal side of the user's hand, and to provide a layer of protection between the user's skin and the various straps, dorsal connection element, and other such connecting elements present in the various embodiments of the present invention. For embodiments without a tongue, the dorsal side of the glove or handwear may comprise a single slit that allows for the ease of donning and doffing the glove or handwear and to seal when securing the glove or handwear. Another alternative would be to have a solid or continuous glove or handwear material with no slit or tongue, and in such embodiments the wrist or proximal end of the glove may comprise an elastic band around at least a portion of the wrist or proximal end to allow for stretching to assist in donning and doffing the glove or handwear as well as in securing the glove or handwear about the user's wrist when donned.

Most embodiments of the present invention also comprise at least one dorsal connection element or dorsal strap connector. Multiple types and styles of dorsal connection elements are envisioned for use with various embodiments of the present invention. Some embodiments may utilize hook and loop fasteners (e.g., Velcro®) as a dorsal connection element. In such embodiments, each of the connecting straps utilized comprise one side of the hook and loop fastener (e.g., hooks), and the other side of the hook and loop fastener (e.g., loops) is disposed on the dorsal side of the glove or hand wear. As such, as the connecting straps are drawn around the user's hand, they can be fastened to the dorsal side of the glove or handwear when the two sides of the hook and loop fastener are connected.

Other embodiments may utilize a buckle style dorsal connection element. A buckle for purposes of the present invention may be any style of buckle attachment known to those skilled in the art. Buckles typically operate by attaching one element to another via a clasp, which secures the first element to the second. The most common buckle comprises several elements including at least a frame and at least one prong, and most also include a chape and a bar to which the prong is attached. The opposite end, article, or element from the buckle generally comprises a series of apertures or holes which are used to place the prong(s) of the buckle through in order to secure the elements together. Embodiments of the present invention utilizing a buckle typically will include the apertures or holes on the connecting straps and the buckle attached to, secured to, or integrated into the dorsal side of the glove or handwear (although the opposite arrangement may be utilized for some embodiments). Accordingly, for buckle embodiments, the connecting straps may be drawn around the user's hand and through the buckle, where the prong(s) may be inserted into a desired hole or holes corresponding to the user's desired fit of the glove, and then secured via the bar and/or frame so that the connecting strap does not come loose from the buckle and the glove or handwear remains securely fit to the user's hand. Other types and varieties of buckles exist and may be used with the present invention. A buckle trim or slide is a style of buckle that typically has no chape or prong. Side release buckles are similar to conventional buckles in that they comprise a male element (the buckle or clasp with the prong) and a female element (the element comprising the apertures or holes), where male buckle element consists of a center guide rod forwardly extending from the front side with two spring arms equally spaced from the center rod, the two spring arms each have a retaining block that terminates at the front end, and the female buckle element has a front open side and two side holes which hold and secure the two spring arms of the male buckle member. Still other types of buckles may include ratchet buckles (see below for description of the ratchet concept), snap-fit buckles, blimp buckles, spur buckles, and the like.

Still other embodiments may utilize a ratchet wheel as the dorsal connection element. A ratchet is a mechanical device that enables continuous linear or rotational motion in one direction while preventing motion in the opposite direction. Ratchets, or ratchet wheels typically comprise a gear and a pawl where the pawl is mounted on a base of some variety and the gear is allowed to spin or move in one direction with the pawl moving freely over the teeth or grooves of the gear, but the pawl falls into place in one of the teeth or grooves of the gear thereby locking and preventing the gear from spinning or moving back in the opposite direction. The pawl must be lifted or otherwise freed from the tooth or groove of the gear and held in the disengaged position to allow the gear to spin or move in the opposite direction, or for the locked element to be drawn from the ratchet or ratchet wheel. More specifically, a common styling of a ratchet comprises a round gear or linear rack with teeth, and a pivoting, spring-loaded pawl that engages the teeth. The teeth are typically uniform but asymmetrical, with each tooth having a moderate slope on one edge and a much steeper slope on the other edge. When the teeth are moving in the unrestricted (i.e., forward) direction, the pawl easily slides up and over the gently sloped edges of the teeth. Also typically, a spring forces the pawl into the depression between the teeth as it passes the tip of each tooth. When the teeth move in the opposite backward) direction, the pawl preferably catches against the steeply sloped edge of the first tooth it encounters, thereby locking it against the tooth and preventing any further motion in that direction. Because the ratchet can only stop backward motion at discrete points (i.e., at tooth boundaries), a ratchet does allow a limited amount of backward motion. This backward motion is known as backlash and is limited to a maximum distance equal to the spacing between the teeth. It may be preferable to try and minimize backlash in a ratchet or ratchet wheel, particularly given the relatively small increments of adjustment that may be used for the purposes of adjusting a glove on a user's hand. In order to minimize backlash then, a smooth, toothless ratchet with a high friction surface such as rubber is sometimes used. The pawl bears against the surface at an angle so that any backward motion will cause the pawl to jam against the surface and thus prevent any further backward motion. Since the backward travel distance is primarily a function of the compressibility of the high friction surface, this mechanism can result in significantly reduced backlash. Thus, not only is backlash minimized, but also such embodiments effectively create a continuously adjustable system, which is particularly useful for creating a customized fit for the user's hand. Thus the ratchet concept can be embodied in a wheel device which is turned, thereby drawing at least the connecting straps in and tightening and securing the glove or handwear. Preferably, the ratchet or ratchet wheel is adapted to support multiple straps which can then be tightened simultaneously by turning the wheel. Ratchets or ratchet wheels can be released and thus allow movement in the loosening or opposite direction by any methods or device known in the art such as a release button or lever.

Many embodiments of the present invention further include one or more tension straps. Tensions straps, for purposes of the present invention, are similar to the connecting straps, described above, but rather than wrapping around the base of the metacarpals like the connecting straps, the tension straps run along the dorsal side of the glove or handwear. More specifically, the tension straps preferably distally connect to the fingers of the glove or handwear. The tension straps may run the length of the fingers of the glove or handwear; however, more preferably, the tension straps connect to the valleys between the fingers of the gloves or handwear, herein referred to as the web or finger web portion of the glove or handwear.

Proximally, the tension straps may connect to the dorsal connection point or the tongue of the glove or handwear depending on the embodiment. The tension straps, in all embodiments, are adapted to draw the fingers of the glove or handwear proximally when the glove or handwear is tightened or fastened on to the user's hand. For example, if the tension straps are proximally connected to a tongue of the glove or handwear, when the tongue is pulled proximally, the tension straps are similarly pulled proximally, thus tightening the fingers and finger webs of the gloves to the user's hand. In an alternate example, the tension straps may be integrated into or connected to a ratchet wheel dorsal connection element along with the connecting straps such that when the ratchet wheel is turned in the tightening direction (generally clockwise, though ratchet wheels can be designed in either orientation) each of the straps—connecting and tension—are drawn into the ratchet wheel and tightened. Accordingly, such an embodiment tightens and secures the glove or handwear to the user's hand in multiple dimensions and planes with the operation of a single dorsal connecting element mechanism. The tension straps may similarly connect to any dorsal connection element embodiment and thus are preferably enabled to tighten in a similarly easy fashion when the connecting straps are tightened or secured with the dorsal connection element. In embodiments where tension straps are used to tighten or secure the fingers, finger webs, or generally the distal portion of the glove or handwear, preferably, at least one tension strap is attached to at least one finger or finger web portion of the glove or handwear. More preferably, at least two tension straps are attached to at least one finger or finger web portion of the glove or handwear. Still more preferably, at least three tension straps are attached to at least one finger or finger web portion of the glove or handwear. Yet more preferably, at least four tension straps are attached to at least one finger or finger web portion of the glove or handwear. Even more preferably, at least five tension straps are attached to at least one finger or finger web portion of the glove or handwear. Still yet more preferably, at least six tension straps are attached to at least one finger or finger web portion of the glove or handwear. Yet even more preferably, at least seven tension straps are attached to at least one finger or finger web portion of the glove or handwear. Even still more preferably, at least eight tension straps are attached to at least one finger or finger web portion of the glove or handwear. Most preferably, a plurality of tension straps are attached to a plurality of fingers or finger web portions of the glove or handwear. The tension straps may be attached to, affixed to, or integrated into the glove or handwear in any manner known to those skilled in the art. They may run along the dorsal side of the glove or handwear and held to it with loops or hooks. More preferably, the tension straps are sewn or stitched into the material, such as between an inner material layer (e.g., the material layer that contacts the dorsal side of the user's hand, and an outer material layer (e.g., the material layer that faces out away from the user and toward the environment, or otherwise fed through or integrated into the material of the glove or handwear. The tension straps may run through interior channels built into the material that are at least partially reinforced or constructed of a more resilient material (e.g., plastic) such that the movement of the tension straps inside the glove or handwear with each tightening or loosening does not wear or erode the material of the glove or handwear. The tension straps may be constructed of any suitable material including metal (e.g., metal filaments, wires, braided wires, or the like), plastic (e.g., acrylonitrile butadiene styrene (ABS), polylactic acid (PLA), or other such plastics and polymers), or rubber, elasticized or elastic filaments, wires, cables or the like. Where a plurality of tension straps are utilized, the tension straps my individually run from their distal connection point(s) at the fingers or finger webs, or may join at a common tension strap connection from which a single tension connection strap may extend to the dorsal connection element. The tension strap(s) of a given embodiment may be individually tightened or secured allowing the user to truly customize the fit of each finger individually, however, the ease and rapidity of adjusting the entire glove or handwear in multiple dimensions and planes with a single adjustment may be preferable. Many embodiments of the present invention include a flexible mesh material adapted for breathability, flexibility, and enhanced secure fit to the palm of the user's hand. Traditional gloves or handwear often bunch or shift while the user is wearing the glove or handwear and moving or using his or her hand. Some embodiments of the present invention include a more flexible, elasticized material to construct at least a portion of the palmar side of the glove or handwear which enables the glove to flex and conform to the palm of the user's hand as the user moves the hand. By mesh, it is intended that the material may be at least semi-porous, but may also be a breathable yet solid fabric without holes that characterize most materials identified as mesh. The operative characteristic of this material is to conform to the user's hand without restricting movement and to minimize bunching and shifting while the glove or handwear is in use. The flexible material may also preferably be adapted to improve the user's grip, whether by the nature of the material itself, or by the presence of grip enhancing nodules or nodes. These nodes may comprise a rubberized or other such material with a high friction coefficient. Preferably, the flexible material comprises at least 10% of the palm portion of the glove or handwear. More preferably, the flexible material comprises at least 20% of the palm portion of the glove or handwear. Still more preferably, the flexible material comprises at least 30% of the palm portion of the glove or handwear. Yet more preferably, the flexible material comprises at least 30% of the palm portion of the glove or handwear. Even more preferably, the flexible material comprises at least 60% of the palm portion of the glove or handwear. Still yet more preferably, the flexible material comprises at least 70% of the palm portion of the glove or handwear. Yet even more preferably, the flexible material comprises at least 90% of the palm portion of the glove or handwear. Even still more preferably, the flexible material comprises at least 90% of the palm portion of the glove or handwear. The flexible material may also be used on either the palmar or dorsal side of the fingers of the glove or handwear corresponding to the knuckles or joints of the user's hand in order to increase flexibility and customization of the fit to the user's hand.

Further adaptations can be made to the glove with various materials and stitch designs so that the glove forms to the palm when tightened. When observing the palms skin folds with the palm flexed a natural triangle shape is made at the medial aspect. By utilizing the natural shape of the palm along with the invention's straps, properly sized gloves could then provide the constant snug feel to the fingers and palm athletes are looking for when using their hands to grip and move in multiple directions.

One embodiment of the present invention includes a glove or handwear comprising: a dorsal side, a volar side, a medial side, a lateral side, a distal side, and a proximal side, the dorsal side comprising at least one dorsal connection element; at least one medial connecting strap element connected to a common strap connection point located on the volar side of the glove, the medial connecting strap element adapted to extend, from the common strap connection point, substantially proximal and wrap around dorsally the proximal end of at least the fifth metacarpal, and to extend substantially laterally over the dorsal side of the glove; and at least one lateral connecting strap element connected to the common strap connection point located on the volar side of the glove, the lateral connecting strap element adapted to extend, from the common strap connection point, substantially proximal and wrap around dorsally the proximal end of at least the first metacarpal, and to extend substantially medially over the dorsal side of the glove; wherein the medial connecting strap element is further adapted to avoid the distal end of the ulna and the lateral connecting strap is further adapted to avoid the distal end of the radius, and the medial and lateral connecting strap elements are adapted to attach together and to the dorsal connection element.

Another embodiment of the present invention includes a glove or handwear comprising: a dorsal side, a volar side, a medial side, a lateral side, a distal side, and a proximal side, the dorsal side comprising at least one dorsal connection element; at least one medial connecting strap element connected to a common strap connection point located on the volar side of the glove, the medial connecting strap element adapted to extend, from the common strap connection point, substantially proximal and wrap around dorsally the proximal end of at least the fifth metacarpal, and to extend substantially laterally over the dorsal side of the glove; and at least one lateral connecting strap element connected to the common strap connection point located on the volar side of the glove, the lateral connecting strap element adapted to extend, from the common strap connection point, substantially proximal and wrap around dorsally the proximal end of at least the first metacarpal, and to extend substantially medially over the dorsal side of the glove; wherein the medial connecting strap element is further adapted to avoid the distal end of the ulna and the lateral connecting strap is further adapted to avoid the distal end of the radius, and the medial and lateral connecting strap elements are adapted to attach together and to the dorsal connection element on the dorsal side of the glove that is a ratchet wheel element adapted to be rotated in a first direction and draw in the medial and lateral connecting strap elements.

Still another embodiment of the present invention includes a glove or handwear comprising: a dorsal side, a volar side, a medial side, a lateral side, a distal side, and a proximal side, the dorsal side comprising at least one dorsal connection element, the volar side of the glove comprising a flexible elastic material adapted to naturally provide flexion of fingers on the volar side the glove, and wherein extension of the fingers extends and tightens the flexible elastic material against the palm of a wearer's hand; at least one medial connecting strap element connected to a common strap connection point located on the volar side of the glove, the medial connecting strap element adapted to extend, from the common strap connection point, substantially proximal and wrap around dorsally the proximal end of at least the fifth metacarpal, and to extend substantially laterally over the dorsal side of the glove; and at least one lateral connecting strap element connected to the common strap connection point located on the volar side of the glove, the lateral connecting strap element adapted to extend, from the common strap connection point, substantially proximal and wrap around dorsally the proximal end of at least the first metacarpal, and to extend substantially medially over the dorsal side of the glove; wherein the medial connecting strap element is further adapted to avoid the distal end of the ulna and the lateral connecting strap is further adapted to avoid the distal end of the radius, and the medial and lateral connecting strap elements are adapted to attach together and to the dorsal connection element.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention and together with the description serve to explain the principles and operation of the invention.

DETAILED DESCRIPTION OF DRAWINGS AND A PREFERRED EMBODIMENT

Figure 1:
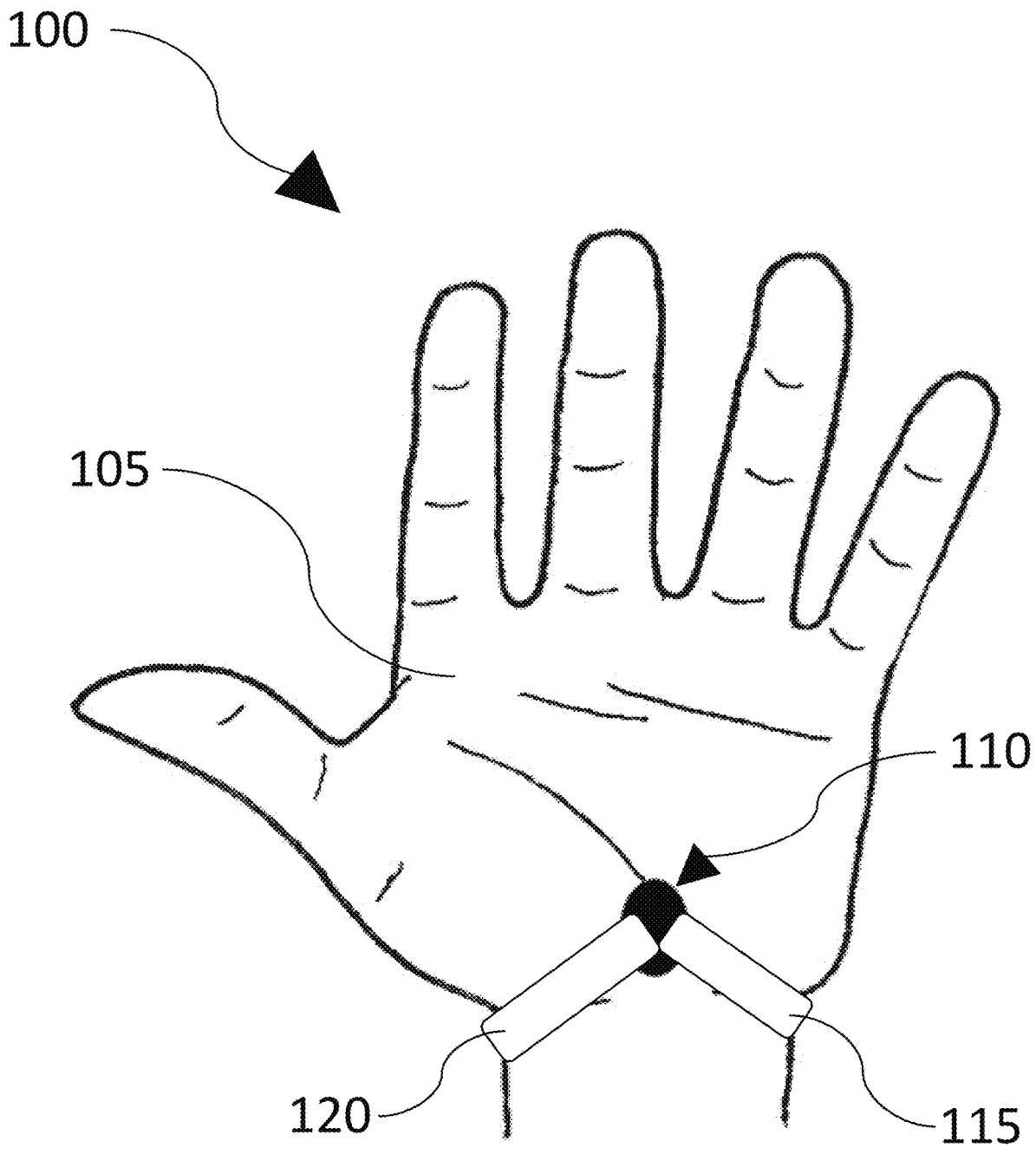
FIG. 1. Picture depicting the palmar side of a left-hand glove with medial and lateral straps connected to the palmar side of the glove at a common strap connection point.

Now referring to the drawings and figures, FIG. 1 is a picture depicting a left-handed glove 100 embodiment of the present invention, as viewed from the volar or palmar side 105, of the user's hand, as described herein. A common strap connection point 110 is located proximally on the palm of the glove. The common strap connection point 110 may be a single point on the volar side 105 of the glove 100 to which medial and lateral strap elements 115, 120 connect. The common strap connection point 110 preferably comprises an additional support element (not shown) in order to strengthen and secure the connection of the medial and lateral strap elements 115, 120 to the glove 100. The support element (not shown) of the common strap connection point 110 may comprise a separate and distinct element or feature attached to, affixed to, or integrated into the volar side 105 of the glove 100. The support element (not shown) may comprise a section or portion of material integrated into the volar side 105 of the glove 100, where the support element material has a higher tensile strength compared to the material of which the majority of the glove 100, such that the support element effectively replaces the section of the volar side 105 of the glove 100, at the location of the common strap connection point 110. For example, the majority of the glove may be constructed of a strong yet comfortable material, for example cabretta leather, whereas at the location of the common strap connection point 110, a section of material with a higher tensile strength, such as kangaroo leather or Kevlar. Alternatively, the support element (not shown) may be an additional element or material integrated into the overall glove 100 material, for example as a middle layer between an inner and outer layer of the glove 100. Regardless of the support element's (not shown) nature, the medial and lateral strap elements 115, 120 attach thereto and are effectively anchored to that common strap connection point 110 on the volar side 105 of the glove 100. Thus, not only does the common strap connection point 110 anchor the medial and lateral strap elements 115, 120, but as the medial and lateral strap elements 115, 120 are pulled and tightened the glove 100 is pulled taught and tightened against the webbed portions of the wearer's fingers. The common strap connection point 110 may be a substantially centralized location on the volar side 105 of the glove 100, though the general location of the common strap connection point 110 need not be any specific location other than on the volar side 105 of the glove 100. The common strap connection point may be, substantially literally, a point on the volar side 105 of the glove 100 to which both medial and lateral strap elements 115, 120 connect with the glove 100 and each other. Alternatively, the common strap connection point 110 may be a general region or area on the volar side 105 of the glove 100, such as an area or region defined by the support element (not shown). In this alternative embodiment, the medial and lateral strap elements 115, 120 need not actually connect with each other. In still other alternative embodiments, a common strap connection point 110 may not be used, and instead each of the medial and lateral strap elements 115, 120 may connect to a separate strap connection point (effectively separate medial and lateral strap connections points), each preferably supported or reinforced as described above. In still further embodiments, the strap connection point(s) 110 and/or support element (not shown) may be made of elastic material that provides the same function as a more rigid or tensile material, but allows for additional flexibility during use of the glove to allow the straps and/or volar side 105 of the glove 100 to flex and move along with the user's hand. The medial strap element 115 preferably extends from the common strap connection point 110 or the medial strap connection point (not shown) and is adapted to wrap around the base of the $5^{th}$ metacarpal. The lateral strap element 120 preferably extends from the common strap connection point 110 or the lateral strap connection point (not shown) and wrap around the base of the $1^{st}$ metacarpal. When both straps have tension they will tighten the glove onto the wearer's hand by pulling the common strap connection point 110 or separate medial and lateral connection points (not shown) proximally. This tension simultaneously draws the fingers of the glove 100 proximally and allows the medial and lateral strap elements 115, 120 to be drawn around the respective metacarpal bones securing the glove securely to the wearer's hand. The behavior and effects of the medial and lateral straps 115, 120 are described in additional drawing descriptions below.

Figure 2A:
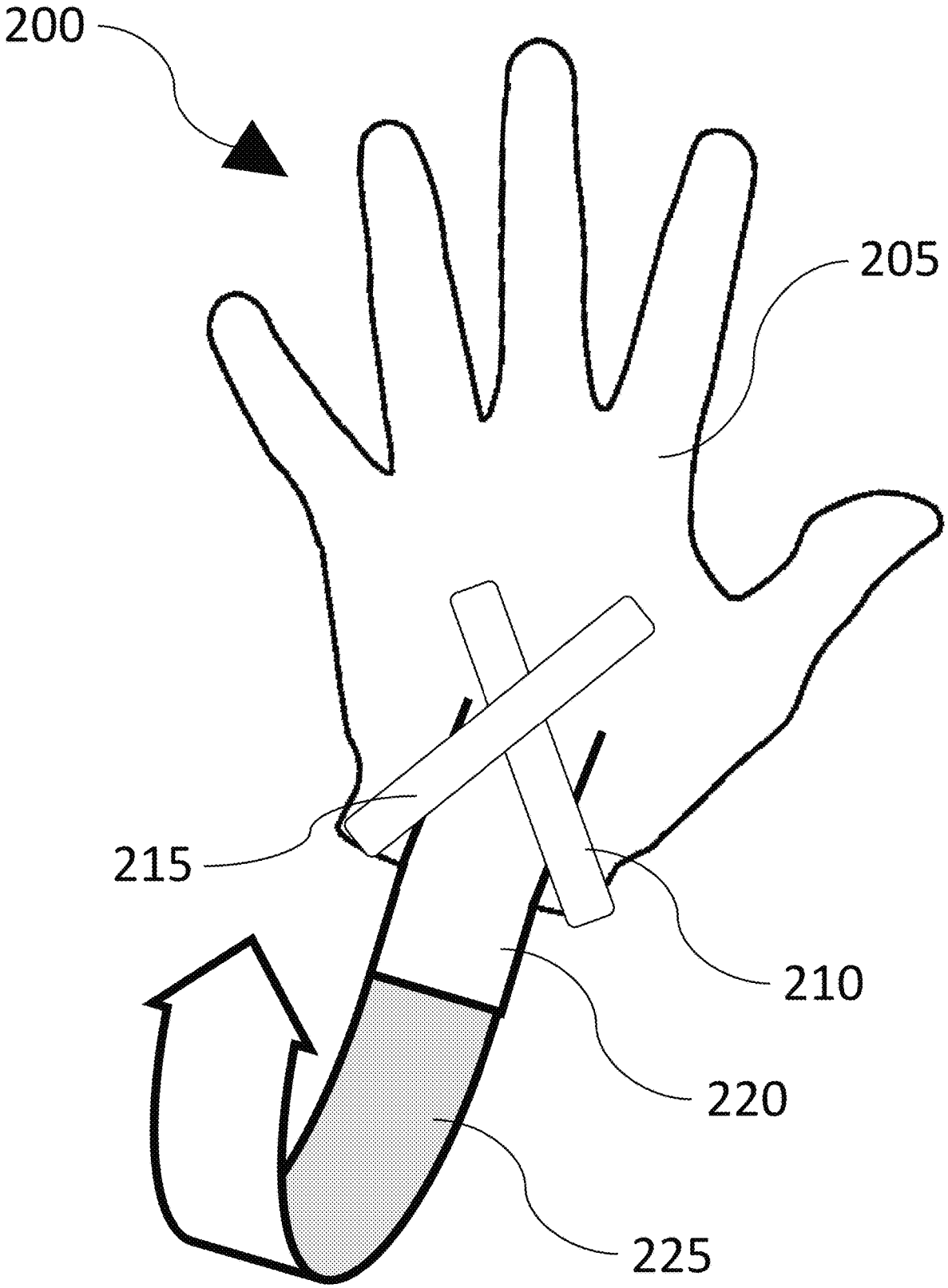
FIGS. 2A-C. Pictures depicting embodiments of the present invention comprising a tongue portion that works in conjunction with medial and lateral straps to secure the glove to the user's hand in multiple dimensions, the multiple embodiments including: A) a long tongue that wraps around the medial and lateral straps to secure them to the glove; B) a shorter tongue that does not wrap over the straps; and C) the same embodiment of B, but further including tension straps to pull the fingers of the glove tighter onto the user's hand.
Figure 2B:
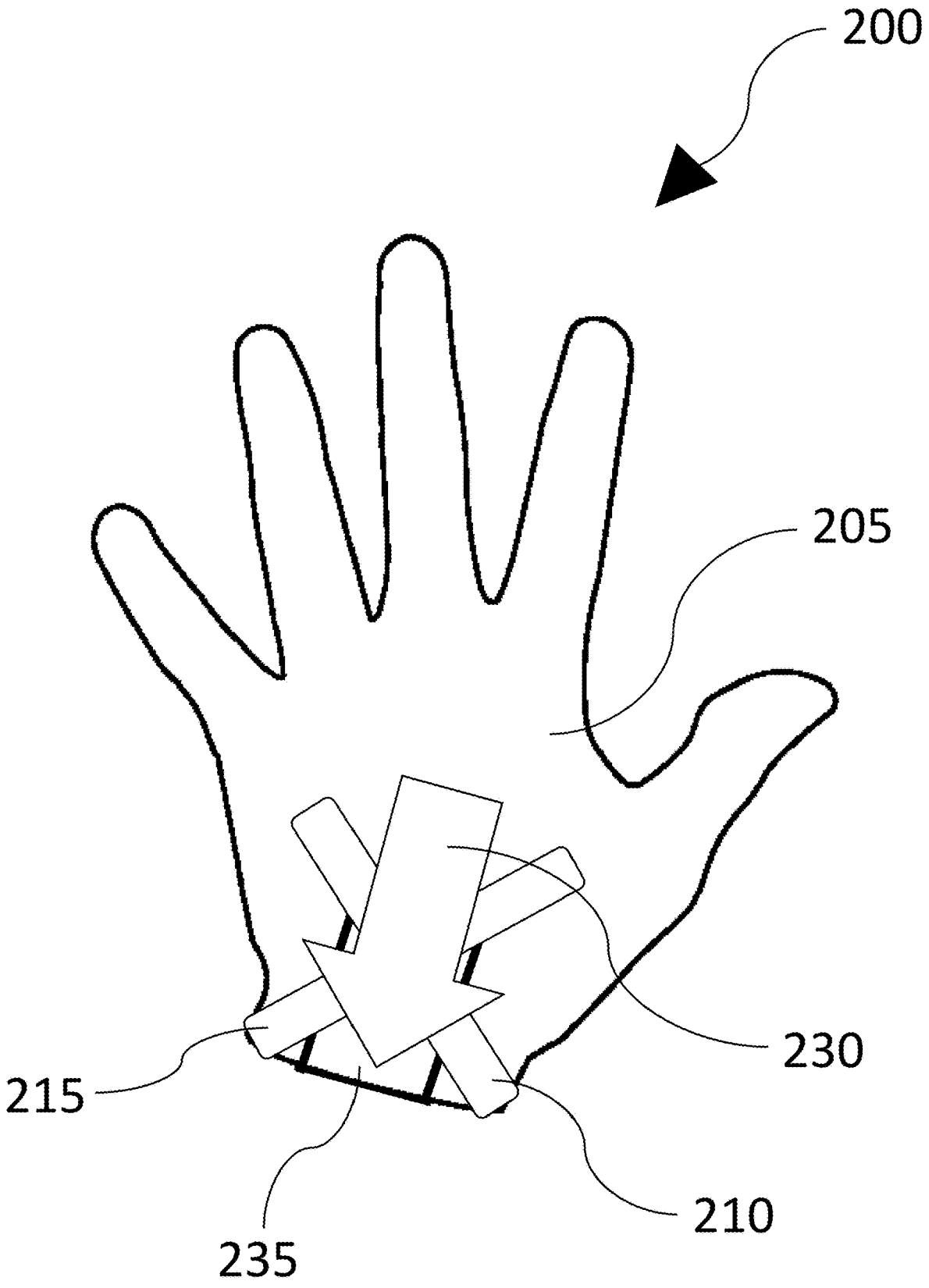
Figure 2C:
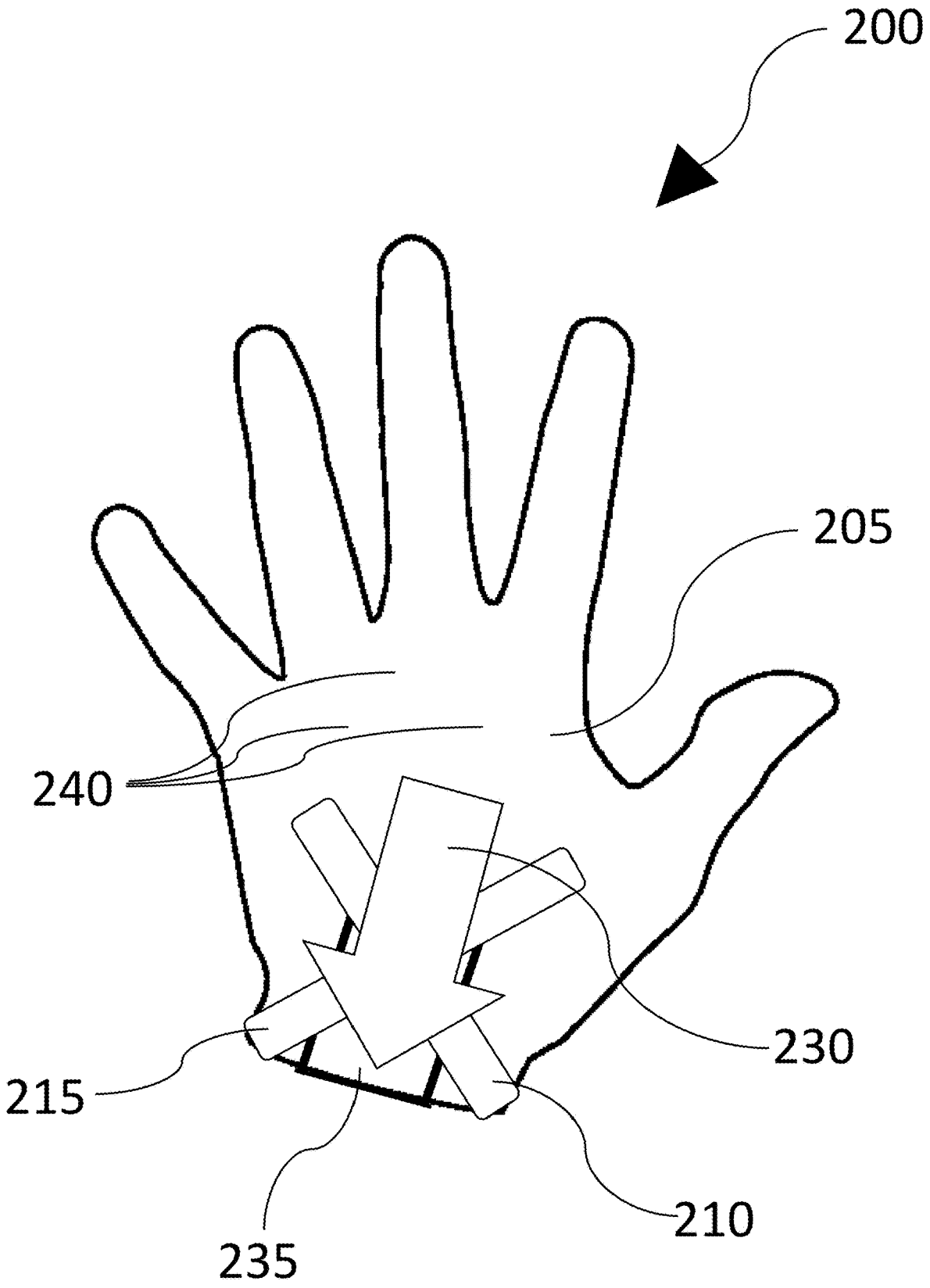

FIGS. 2A-2C depict the dorsal side of the glove for various embodiments of the present invention. FIG. 2A primarily depicts an embodiment of the invention comprising a glove 200 showing the dorsal side 205 of the glove with medial and lateral strap elements 210, 215 extending from the volar side (not shown) of the glove 200 in the manner described above. The medial and lateral strap elements 210, 215 connect and become secured to the dorsal side 205 of the glove via a dorsal connection element (not shown). In the depicted embodiment, the dorsal side 205 of the glove 200 comprises a tongue 220. The tongue 220 may be a section of the dorsal side 205 of the glove 200 that is created by effectively cutting or otherwise separating and differentiating a portion of the dorsal side 205 of the glove 200. Alternatively, the tongue 220 may be a separate piece or element of material that is attached to, affixed to, or integrated into the dorsal side 205 of the glove 200. The tongue 220 preferably operates partially in a similar manner to the tongue of a shoe in that it provides a basis of support for the medial and lateral strap elements 210, 215 to maintain the secure fit of the glove 200 to the user's hand (not shown). The medial and lateral strap elements 210, 215 apply pressure to the dorsal side of the tongue 220 such that said strap elements and the tongue 220 apply pressure and securely fit the glove 200 to the user's hand (not shown). The depicted tongue 220 embodiment, further is adapted to wrap 225 back up and around to cover the dorsal side of the medial and lateral strap elements 210, 215 when they are attached to the dorsal connection element (not shown). This embodiment provides an additional stage of connection, which helps maintain the connection of the medial and lateral strap elements 210, 215 to the dorsal side 205 of the glove 200 and prevent them from coming loose therefrom. Thus, when the glove 200 is fully donned, the medial and lateral strap elements 210, 215 are attached to the dorsal side 205 of the glove 200 via a dorsal connection element (not shown), and are further secured in that position by the tongue 220 being wrapped 225 back up around and on top (dorsal) of the medial and lateral strap elements 210, 215, where all of these connection points secure the glove to the user's hand and maintain a secure fastening of the glove 200 thereto.

FIG. 2B depicts a similar embodiment to that of FIG. 2A, but where the tongue 235 does not wrap around on top (dorsal) of the medial and lateral strap elements 210, 215. In this embodiment, the medial and lateral strap elements attach to the dorsal side 205 of the glove 200 via a dorsal connection element (not shown), as described above, but are not secured in turn by the tongue 235. The tongue 235 in this embodiment more directly relates to the function of a shoe tongue in that it ends substantially near the end of the glove 200 and serves to provide pressure against the user's hand when the medial and lateral strap elements 210, 215 are secured, and to protect the user's hand from rubbing or friction of the medial and lateral strap elements 210, 215. The tongue 235 is pulled 230 proximally as the user dons the glove 200, much like when pulling on a shoe, and the medial and lateral strap elements 210, 215 apply pressure to the tongue and in turn to the dorsal side of the user's hand.

FIG. 2C depicts the same embodiment of FIG. 2B, but with additional features that help secure the glove even further to the user's hand, and particularly regarding the fingers of the user's hand. Specifically, tension straps 240 extend substantially from at least one of the finger-web areas of the glove 200 to substantially near the tongue 235. More preferably, at least two tension straps 240 extend substantially from at least two of the finger-web areas of the glove 200 to substantially near the tongue 235. Still more preferably, at least three tension straps 240 extend substantially from at least three of the finger-web areas of the glove 200 to substantially near the tongue 235. The process of donning the glove 200 typically involves the user pulling 230 the tongue 235 proximally when attempting to fit the glove 200 to his or her hand. When the user pulls 230 the tongue 235 proximally, the tension strap(s) 240 that connect substantially near the tongue 235 are similarly pulled 230 proximally along with the tongue 235, and thus tighten the web-portion of the glove to which each extends, into the actual web of the user's hand. In other words, if there is a tension strap 240 that ends substantially near the web-portion of the glove that corresponds to the junction of the user's ring and middle fingers, then when the user pulls the tongue proximally while donning the glove, the tension strap pulls that corresponding web portion of the glove tighter into the web of the user's hand between the ring and middle fingers. Thus, when the tensions strap(s) 240 are used in combination with the medial and lateral strap elements 210, 215, the present invention serves to provide multiple dimensions and directions of tightening and securing of the glove 200 to the user's hand by tightening the glove 200 against both the volar and dorsal surfaces of the user's hand, as well as proximally with specific respect to the points between the user's fingers, which serves to create a custom fit of the glove 200 to the multiple portions of the user's hand.

Figure 3A:
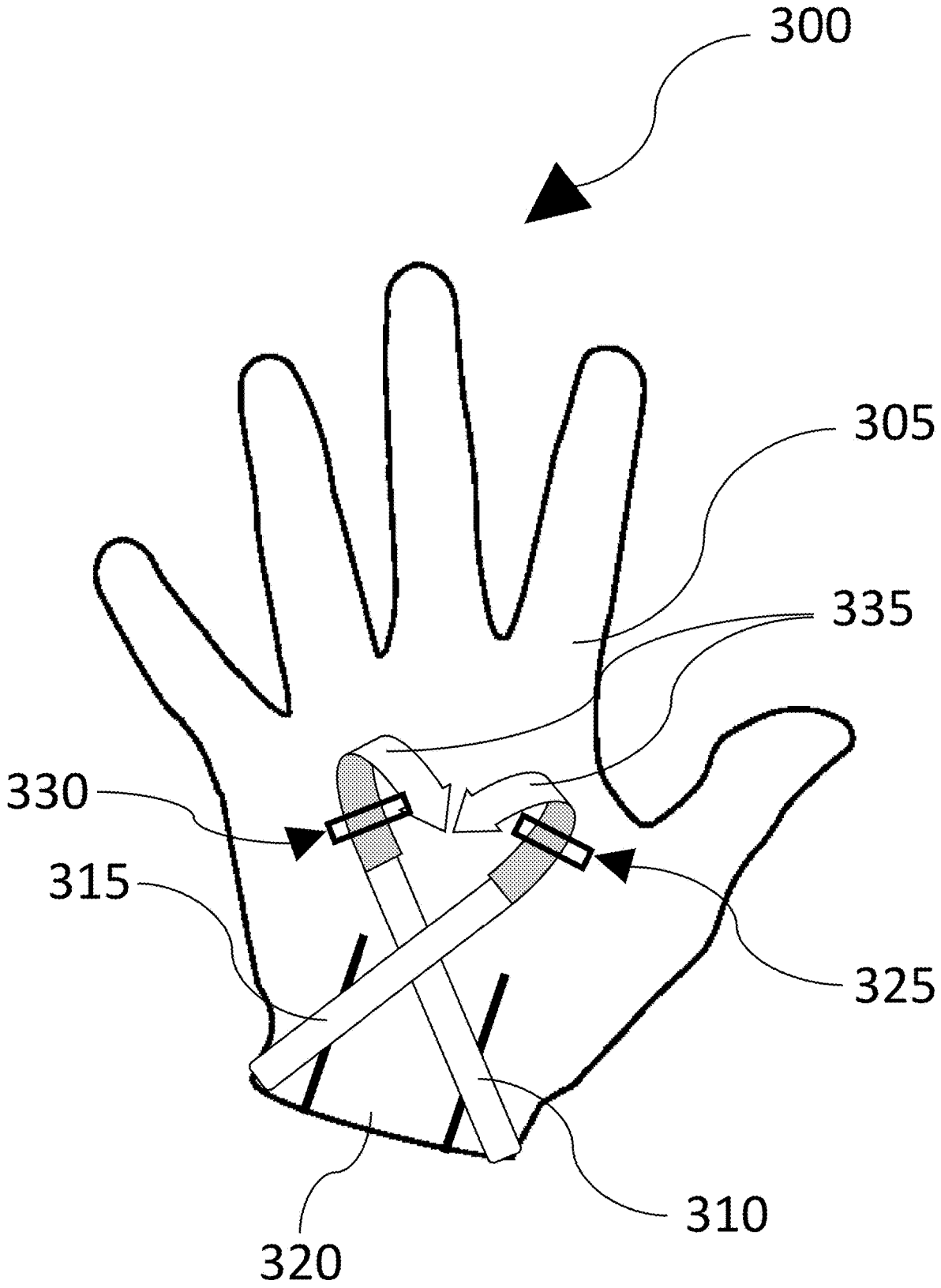
FIGS. 3A-F. Pictures depicting various embodiments of the present invention including: A) a glove comprising a tongue and two separate buckles, one for each of the medial and lateral straps; B) a glove comprising a tongue and a single buckle with is adapted to secure both the medial strap and a lateral strap; C) a glove comprising a tongue and a medial strap and a lateral strap that join together into a common dorsal strap that is secured with a single buckle; D) a glove comprising a tongue, a medial strap and a lateral strap that join together into a common dorsal strap that is secured with a single buckle, and finger tension straps; E) an alternative embodiment of a glove comprising a tongue, and a medial strap and a lateral strap that join together into a common dorsal strap that is secured with a single buckle; and F) an alternative embodiment of a glove comprising a tongue, a medial strap and a lateral strap that join together into a common dorsal strap that is secured with a single buckle, and finger tension straps.

FIGS. 3A-3F depict the dorsal side of the glove for various embodiments of the present invention. FIG. 3A primarily depicts an embodiment of the invention comprising a glove 300 showing the dorsal side 305 of the glove with medial and lateral strap elements 310, 315 extending from the volar side (not shown) of the glove 300 in the manner described above. The medial and lateral strap elements 310, 315 connect and become secured to the dorsal side 305 of the glove via a dorsal connection element (not shown). In the depicted embodiment, the dorsal side 305 of the glove 300 comprises a tongue 320. The tongue 320 may be a section of the dorsal side 305 of the glove 300 that is created by effectively cutting or otherwise separating and differentiating a portion of the dorsal side 305 of the glove 300. Alternatively, the tongue 320 may be a separate piece or element of material that is attached to, affixed to, or integrated into the dorsal side 305 of the glove 300. The tongue 320 preferably operates partially in a similar manner to the tongue of a shoe in that it provides a basis of support for the medial and lateral strap elements 310, 315 to maintain the secure fit of the glove 300 to the user's hand (not shown). The medial and lateral strap elements 310, 315 apply pressure to the dorsal side of the tongue 320 such that said strap elements and the tongue 320 apply pressure and securely fit the glove 300 to the user's hand (not shown). The depicted embodiment includes a buckle or clasp 325, 330 for each of the medial and lateral strap elements. The lateral strap 315 is adapted to extend up over the dorsal side 305 of the glove 300 and through the lateral strap buckle or clasp 325 in order to be secured to the dorsal side 305 of the glove 300. The medial strap 310 operates in much the same way with the medial strap buckle or clasp 330. Optionally, and depending on the embodiment of the buckles or clasps 325, 330, once the medial and lateral straps 310, 315 are placed through the buckles or clasps 325, 330, they can be wrapped 335 back over the buckle or clasp and secured to the dorsal side 305 of the glove 300 or to the dorsal side of the strap 310, 315. This wrap 335 feature or function allows the straps 310, 315 to be secured within the buckle or clasp 325, 330 to prevent movement or slippage of the straps, and thus to maintain the secure fit of the glove 300 to the user's hand. With the buckle or clasp 325, 330 elements, the medial and lateral straps are thus adapted to provide contralateral pressure to the palmar or volar (not shown) side of the glove 300 and in the proximal direction as the straps are pulled around the respective metacarpal regions of the user's hand, and then secured through the respective buckle or strap 325, 330 on the dorsal side 305 of the glove 300. The buckles or straps 325, 330 provide a secure yet adjustable strap attachment point that allows the user to select his or her own desired fit or level of tightness to provide the most comfortable fit. This embodiment provides an additional stage of connection, which helps maintain the connection of the medial and lateral strap elements 310, 315 to the dorsal side 305 of the glove 300 and prevent them from coming loose therefrom. Thus, when the glove 300 is fully donned, the medial and lateral strap elements 310, 315 are attached to the dorsal side 305 of the glove 300 via the medial and lateral strap buckles or clasps 325, 330, where all of these connection points secure the glove to the user's hand and maintain a secure fastening of the glove 300 thereto at various points, rather than just at the wrist as with typical gloves known in the art.

Figure 3B:
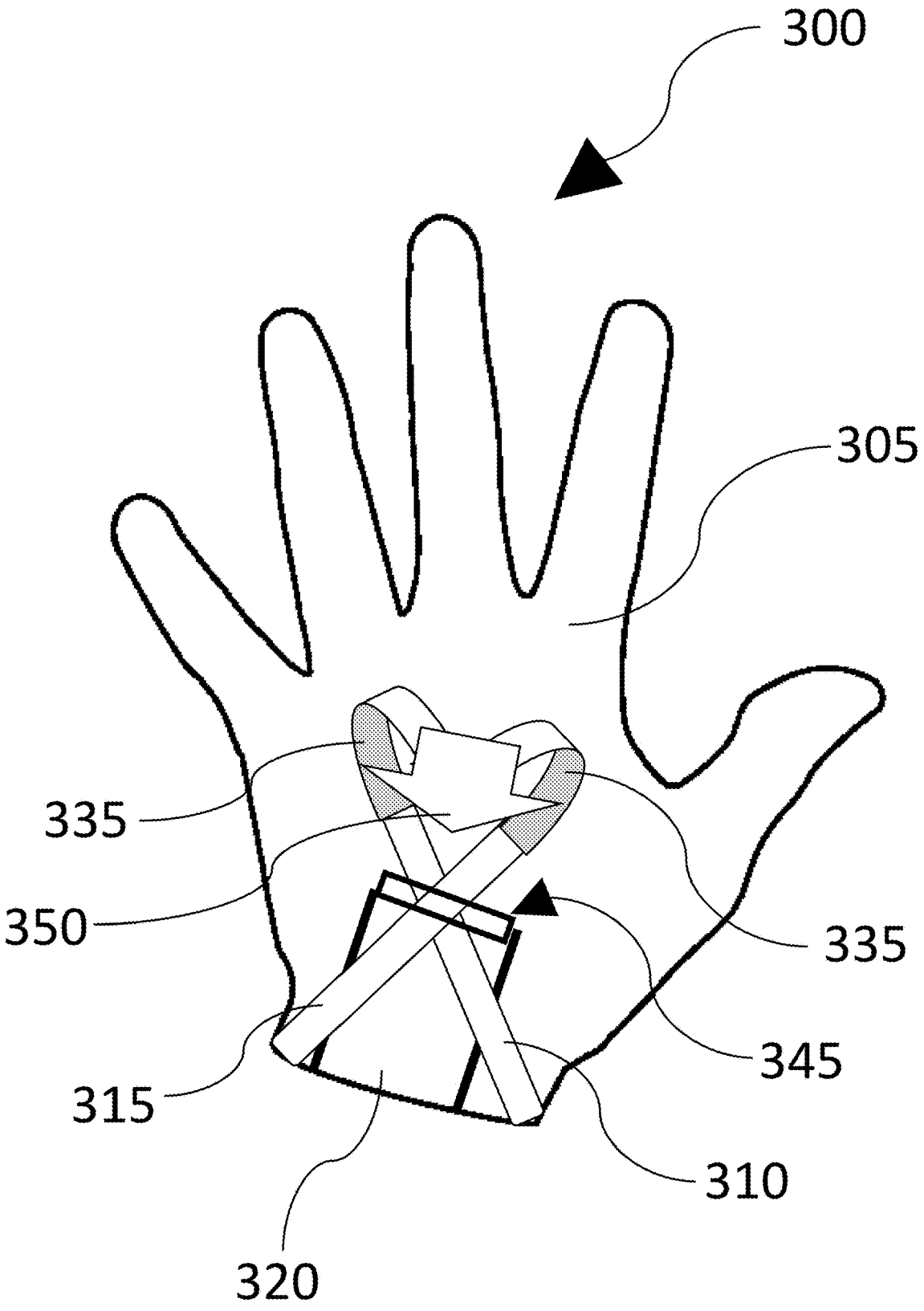

FIG. 3B depicts an embodiment similar to that of FIG. 3A and also comprises a glove 300 showing the dorsal side 305 of the glove with medial and lateral strap elements 310, 315 extending from the volar side (not shown) of the glove 300 in the manner described above. The medial and lateral strap elements 310, 315 connect and become secured to the dorsal side 305 of the glove via a dorsal connection element (not shown). In the depicted embodiment, the dorsal side 305 of the glove 300 comprises a tongue 320. The tongue 320 may be a section of the dorsal side 305 of the glove 300 that is created by effectively cutting or otherwise separating and differentiating a portion of the dorsal side 305 of the glove 300. Alternatively, the tongue 320 may be a separate piece or element of material that is attached to, affixed to, or integrated into the dorsal side 305 of the glove 300. The tongue 320 preferably operates partially in a similar manner to the tongue of a shoe in that it provides a basis of support for the medial and lateral strap elements 310, 315 to maintain the secure fit of the glove 300 to the user's hand (not shown). The medial and lateral strap elements 310, 315 apply pressure to the dorsal side of the tongue 320 such that said strap elements and the tongue 320 apply pressure and securely fit the glove 300 to the user's hand (not shown). The depicted embodiment includes a single dorsal buckle or clasp 345 for both of the medial and lateral strap elements 310, 315. The lateral strap 315 and medial strap 310 are adapted to extend up over the dorsal side 305 of the glove 300 and through the dorsal buckle or clasp 345 in order to be secured to the dorsal side 305 of the glove 300. Optionally, and depending on the embodiment of the dorsal buckle or clasp 345, once the medial and lateral straps 310, 315 are placed through the dorsal buckle or clasp 345, they can be wrapped 335 back over the dorsal buckle or clasp 345 and secured to the dorsal side 305 of the glove 300 or to the dorsal side of the strap 310, 315. This wrap 335 feature or function allows the straps 310, 315 to be secured within the dorsal buckle or clasp 345 to prevent movement or slippage of the straps, and thus to maintain the secure fit of the glove 300 to the user's hand. With the dorsal buckle or clasp 345 elements, the medial and lateral straps are thus adapted to provide contralateral pressure to the palmar or volar (not shown) side of the glove 300 and in the proximal direction as the straps are pulled around the respective metacarpal regions of the user's hand, and then secured through the dorsal buckle or strap 345 on the dorsal side 305 of the glove 300. The dorsal buckles or straps 345 provides a secure yet adjustable strap attachment point that allows the user to select his or her own desired fit or level of tightness to provide the most comfortable fit. This embodiment provides an additional stage of connection, which helps maintain the connection of the medial and lateral strap elements 310, 315 to the dorsal side 305 of the glove 300 and prevent them from coming loose therefrom. Thus, when the glove 300 is fully donned, the medial and lateral strap elements 310, 315 are attached to the dorsal side 305 of the glove 300 via the dorsal buckle or clasp 345, where all of these connection points secure the glove to the user's hand and maintain a secure fastening of the glove 300 thereto at various points, rather than just at the wrist as with typical gloves known in the art.

Figure 3C:
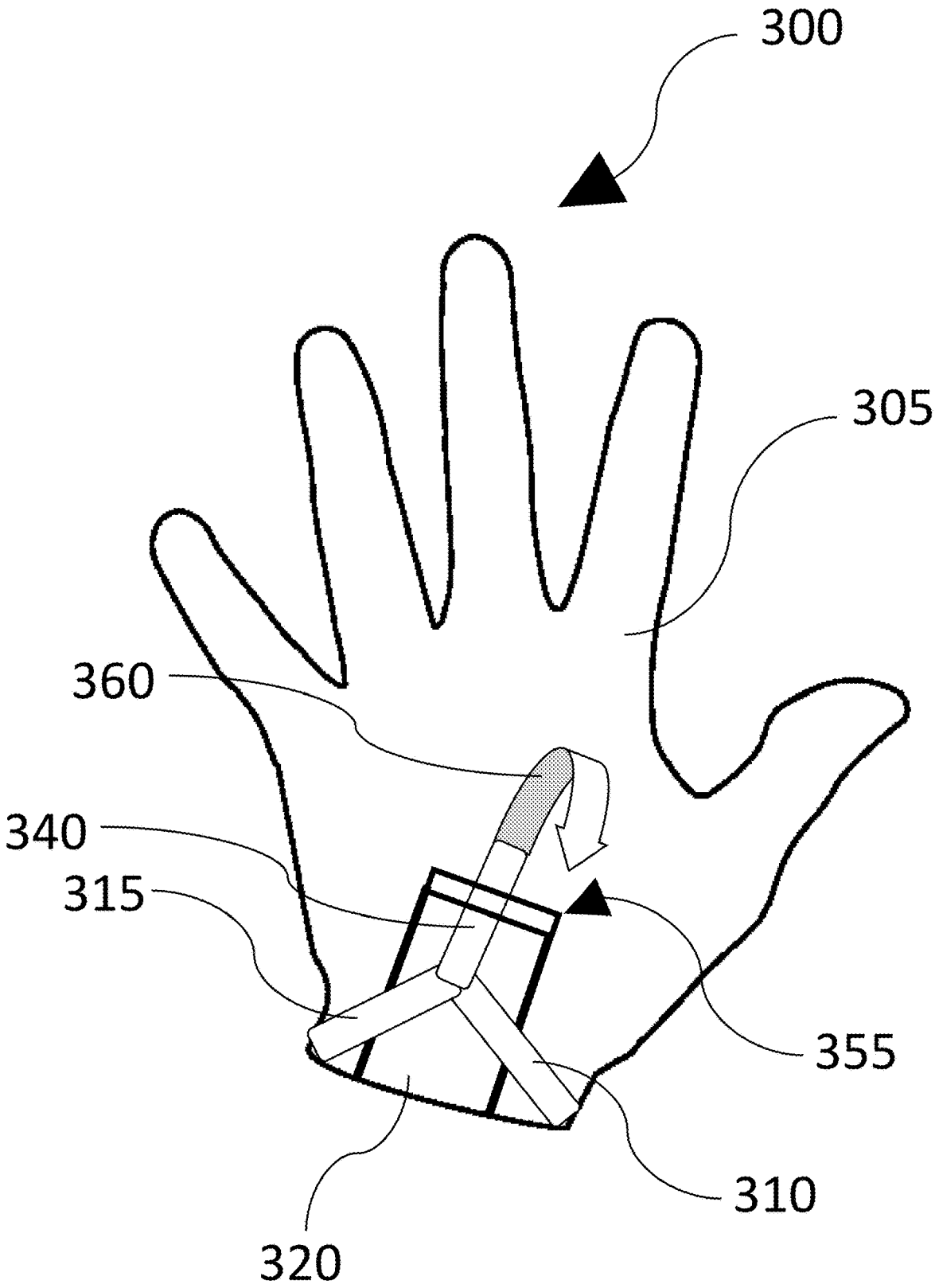

FIG. 3C depicts an alternative embodiment of that depicted in FIG. 3B, that also depicts the dorsal side 305 of a glove 300 comprising a tongue 320 and medial and lateral strap elements 310, 315, that all operate in the same or similar fashion to those described in relation to FIGS. 3A and 3B. The presently depicted embodiment in FIG. 3C differs from that of FIG. 3B in that the medial and lateral strap elements 310, 315 in the present embodiment join together into a common dorsal strap element 340, where it is the common dorsal strap element that extends through the dorsal buckle or clasp 355. The medial and lateral straps 310, 315 combine into the common dorsal strap 340 and the common dorsal strap 340 is then placed into or through the dorsal buckle or clasp 355. As the common dorsal strap 340 is pulled, it in turn pulls the medial and lateral straps 310, 315. The common dorsal strap 340 can be adapted to be placed into the buckle or clasp 355 in either the proximal or distal direction, and similarly can be adapted to be pulled in either direction in order to engage the medial and lateral straps 310, 315 to tighten the glove against the user's hand. Thus, the single common dorsal strap 340 is used to apply tension and pressure to the other components, while only requiring the user to manipulate a single strap while still tightening and securing the glove 300 to his or her hand in a manner similar to the previously depicted embodiments. The common dorsal strap 340 may be a separate structure from each of the medial and lateral straps 310, 315, and attached to them at a connection point (not shown). Alternatively, one or more of the straps 310, 315, 340 can be constructed from a single piece or material and attached to glove at the medial and lateral strap connection points (not shown) on the palmar or volar side (not shown) of the glove 300. Much like above, optionally, and depending on the embodiment of the dorsal buckle or clasp 355, once the common dorsal strap 340 is placed through the dorsal buckle or clasp 355, it can be wrapped 360 back over the dorsal buckle or clasp 355 and secured to the dorsal side 305 of the glove 300 or to the dorsal side of at least one of the straps 310, 315, 340. This wrap 360 feature or function allows the common dorsal strap 340 to be secured within the dorsal buckle or clasp 355 to prevent movement or slippage of the straps, and thus to maintain the secure fit of the glove 300 to the user's hand.

Figure 3D:
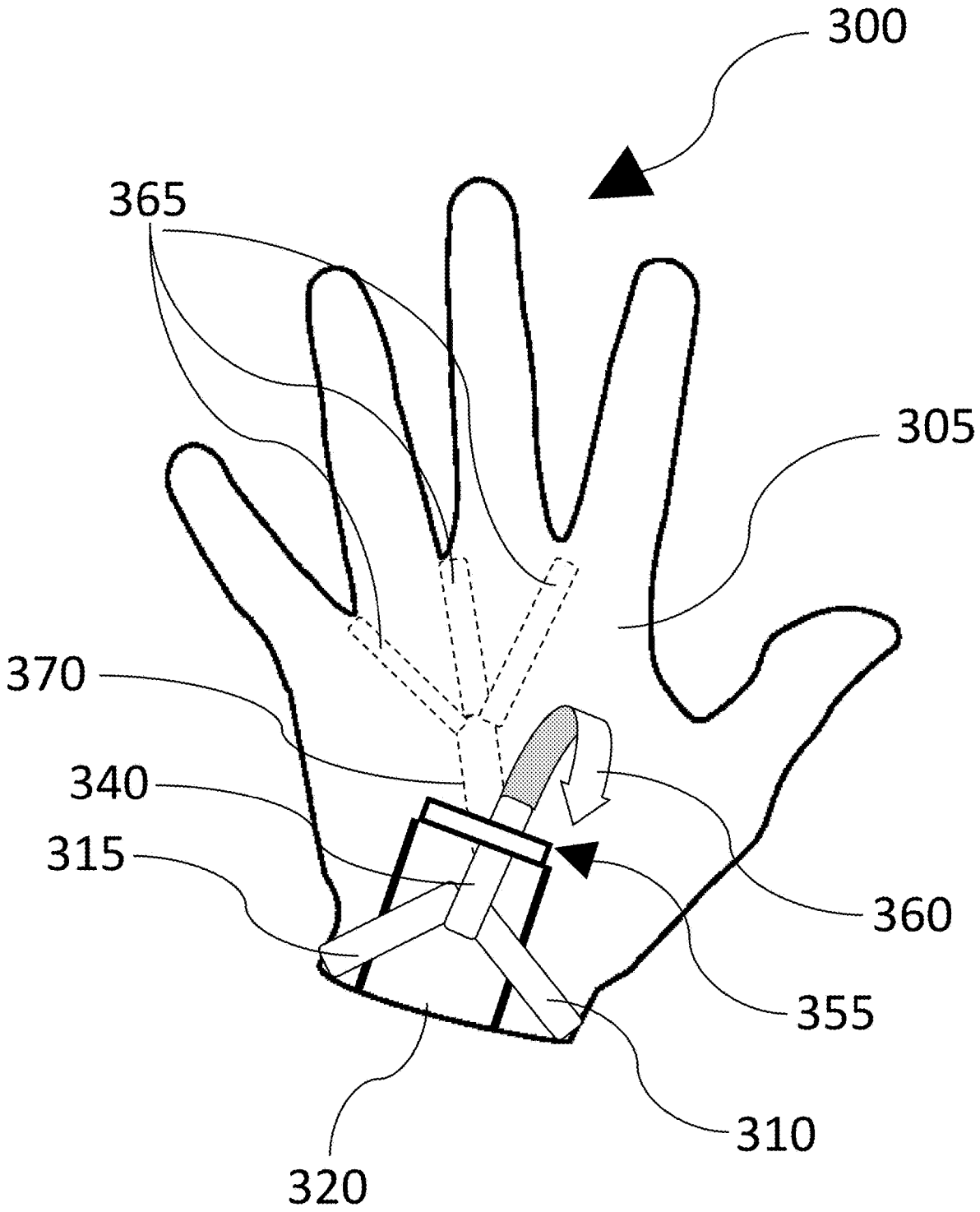
Figure 3E:
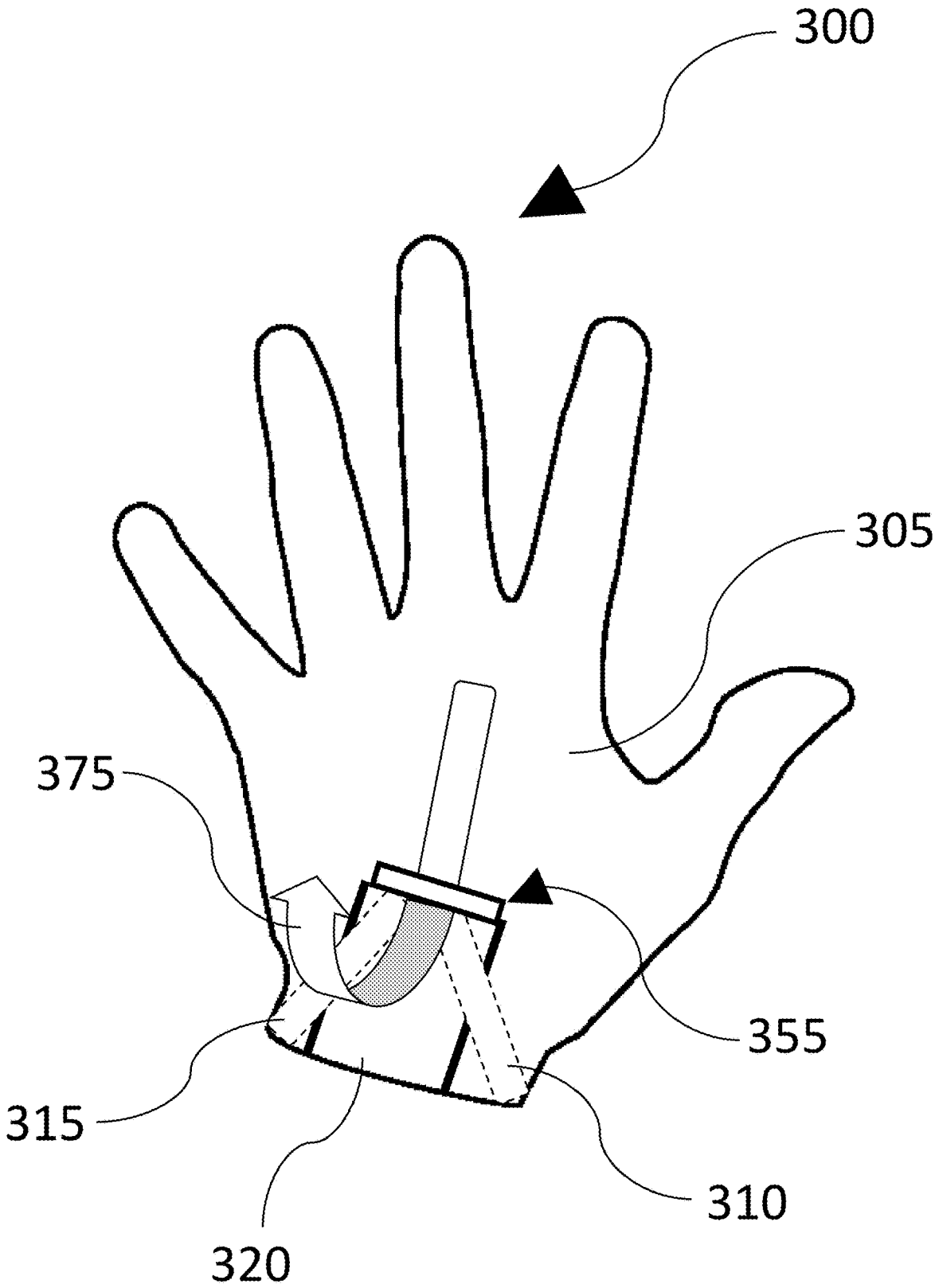
Figure 3F:
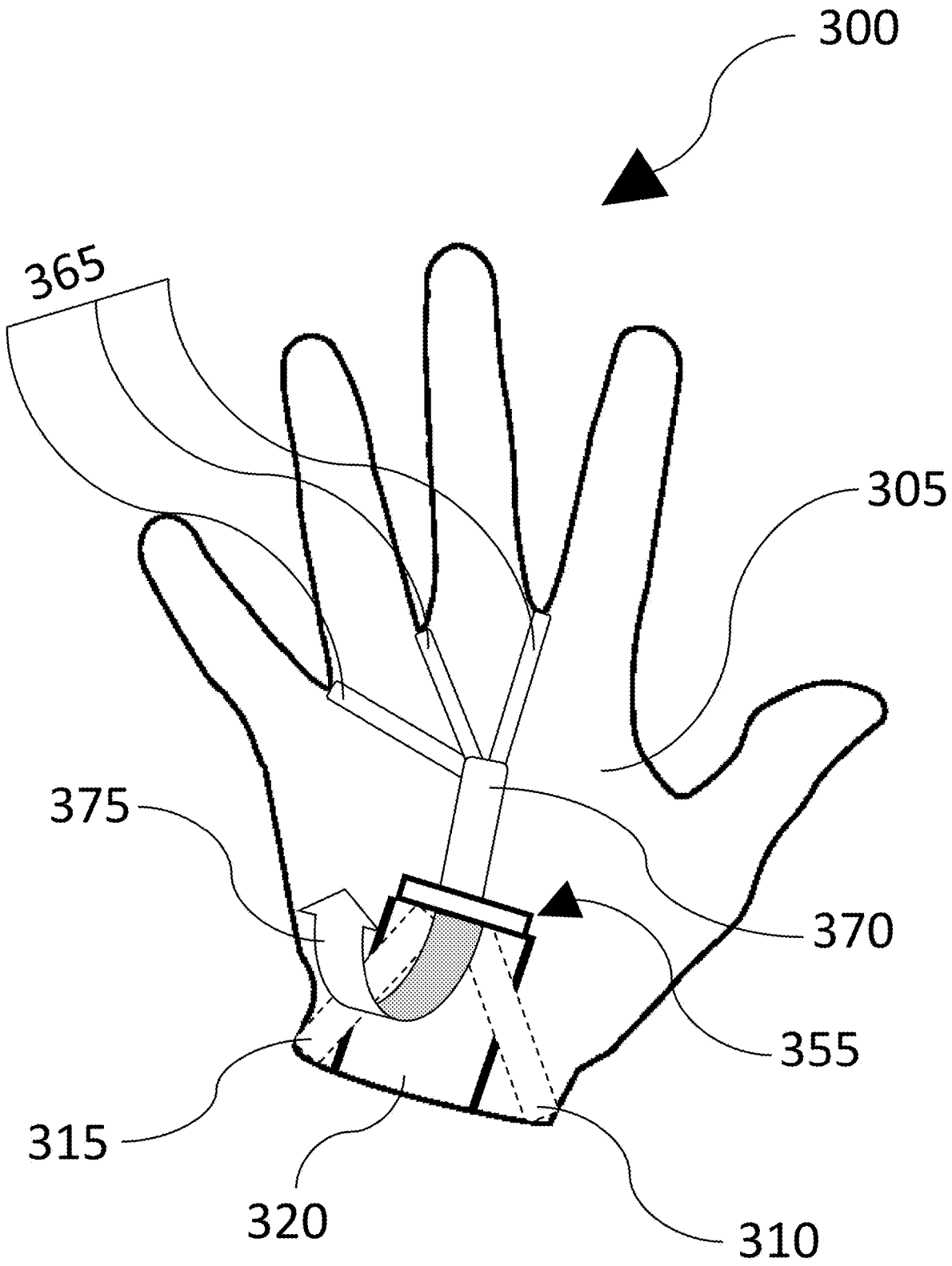

FIG. 3D depicts another alternative embodiment to those depicted in FIGS. 3B and 3C, that also depicts the dorsal side 305 of a glove 300 comprising a tongue 320 and medial and lateral strap elements 310, 315, that all operate in the same or similar fashion to those described in relation to FIGS. 3A to 3C. The presently depicted embodiment in FIG. 3D differs from that of FIG. 3B in that the medial and lateral strap elements 310, 315 in the present embodiment join together into a common dorsal strap element 340, where it is the common dorsal strap element that extends through the dorsal buckle or clasp 355. The medial and lateral straps 310, 315 combine into the common dorsal strap 340 and the common dorsal strap 340 is then placed through the dorsal buckle or clasp 355. As the common dorsal strap 340 is pulled, it in turn pulls the medial and lateral straps 310, 315. The common dorsal strap 340 can be adapted to be placed into the buckle or clasp 355 in either the proximal or distal direction, and similarly can be adapted to be pulled in either direction in order to engage the medial and lateral straps 310, 315 to tighten the glove against the user's hand. Thus, the single common dorsal strap 340 is used to apply tension and pressure to the other components, while only requiring the user to manipulate a single strap while still tightening and securing the glove 300 to his or her hand in a manner similar to the previously depicted embodiments. The common dorsal strap 340 may be a separate structure from each of the medial and lateral straps 310, 315, and attached to them at a connection point (not shown). Alternatively, one or more of the straps 310, 315, 340 can be constructed from a single piece or material and attached to glove at the medial and lateral strap connection points (not shown) on the palmar or volar side (not shown) of the glove 300. Much like above, optionally, and depending on the embodiment of the dorsal buckle or clasp 355, once the common dorsal strap 340 is placed through the dorsal buckle or clasp 355, it can be wrapped 360 back over the dorsal buckle or clasp 355 and secured to the dorsal side 305 of the glove 300 or to the dorsal side of at least one of the straps 310, 315, 340. This wrap 360 feature or function allows the common dorsal strap 340 to be secured within the dorsal buckle or clasp 355 to prevent movement or slippage of the straps, and thus to maintain the secure fit of the glove 300 to the user's hand. The presently depicted embodiment further includes the additional feature of tension straps 365 that extend substantially from at least one of the finger-web areas of the glove 300 to substantially near the tongue 320. More preferably, at least two tension straps 365 extend substantially from at least two of the finger-web areas of the glove 300 to substantially near the tongue 320. Still more preferably, at least three tension straps 365 extend substantially from at least three of the finger-web areas of the glove 300 to substantially near the tongue 320. Optionally, a common tension strap 370 may connect each of the individual tensions straps 365 and then the common tensions strap may extend substantially from the point at which it connects and combines the individual tension straps 365 to substantially near the tongue 320. The process of donning the glove 300 typically involves the user pulling the tongue 320 proximally when attempting to fit the glove 300 to his or her hand. When the user pulls the tongue 320 proximally, the tension strap(s) 365 that connect substantially near the tongue 320 are similarly pulled proximally along with the tongue 320, and thus tighten the web-portion of the glove to which each extends, into the actual web of the user's hand. In the optional embodiment with a common tension strap 370, pulling the tongue 320 would then pull the common tension strap 370 which then in turn would pull the individual tension straps 365 and tighten the finger web-portion of the glove 300 to the user's hand. In other words, if there is a tension strap 365 that ends substantially near the web-portion of the glove that corresponds to the junction of the user's ring and middle fingers, then when the user pulls the tongue proximally while donning the glove, the tension strap pulls that corresponding web portion of the glove tighter into the web of the user's hand between the ring and middle fingers. The tension straps 365 may also be attached to or integrated with the medial and lateral straps 310, 315 and/or the common dorsal strap 340 such that when the straps are pulled and tightened, the tensions straps are similarly engaged as when the tongue 320 is pulled as just described. Thus, when the tension strap(s) 365 are used in combination with the medial and lateral strap elements 310, 315, the present invention serves to provide multiple dimensions and directions of tightening and securing of the glove 300 to the user's hand by tightening the glove 300 against both the volar and dorsal surfaces of the user's hand, as well as proximally with specific respect to the points between the user's fingers, which serves to create a custom fit of the glove 300 to the multiple portions of the user's hand.

Figure 4A:
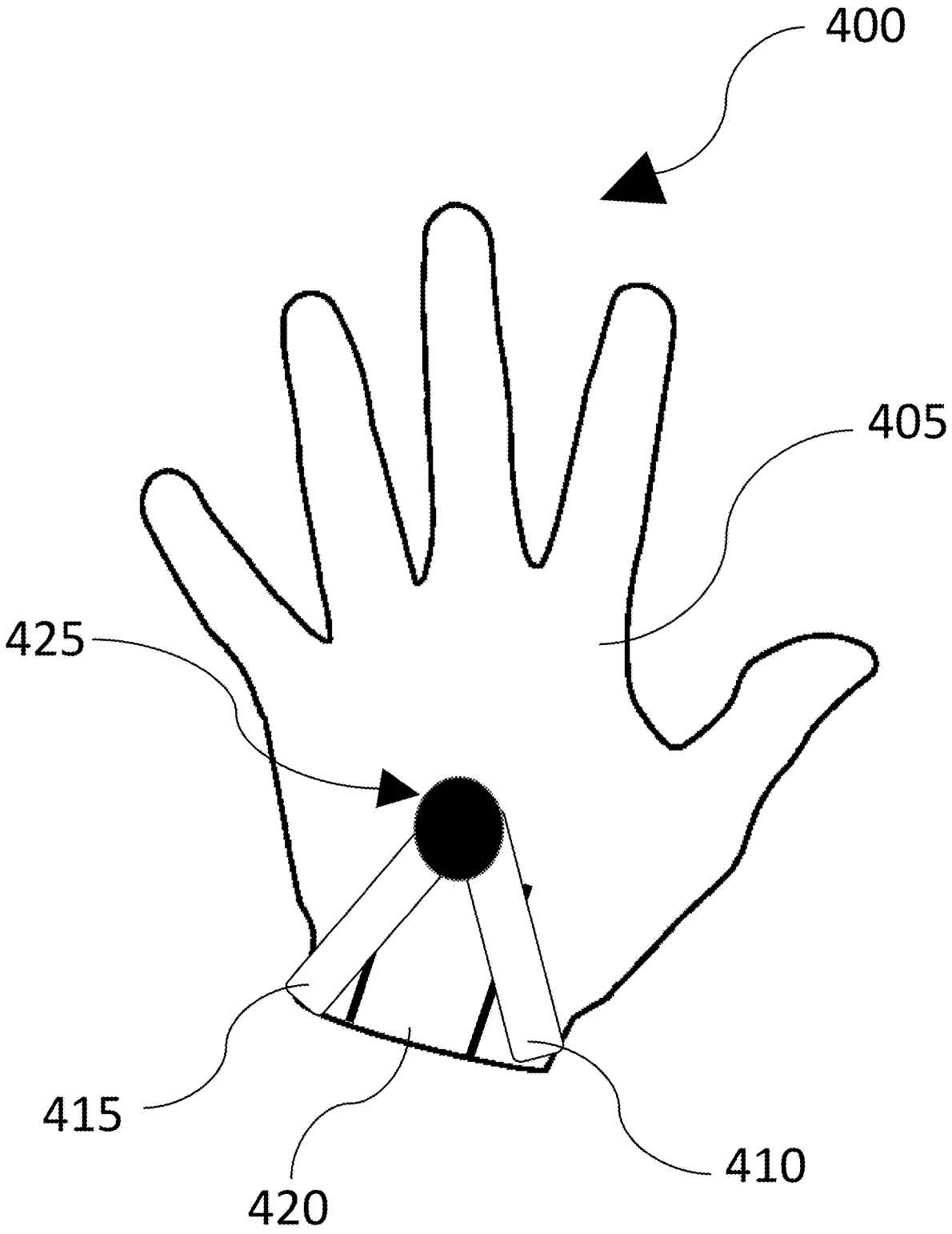
FIGS. 4A-C. Pictures depicting various embodiments of a glove of the present invention including: A) a glove comprising a tongue, medial and lateral straps, and a ratchet wheel adapted to tighten and secure the straps; B) a glove comprising a tongue, medial and lateral straps, a ratchet wheel adapted to tighten and secure the medial and lateral straps, and finger tension straps; and C) a glove comprising a tongue, medial and lateral straps, finger tension straps, and a ratchet wheel adapted to tighten and secure the medial and lateral straps as well as the finger tension straps.
Figure 4B:
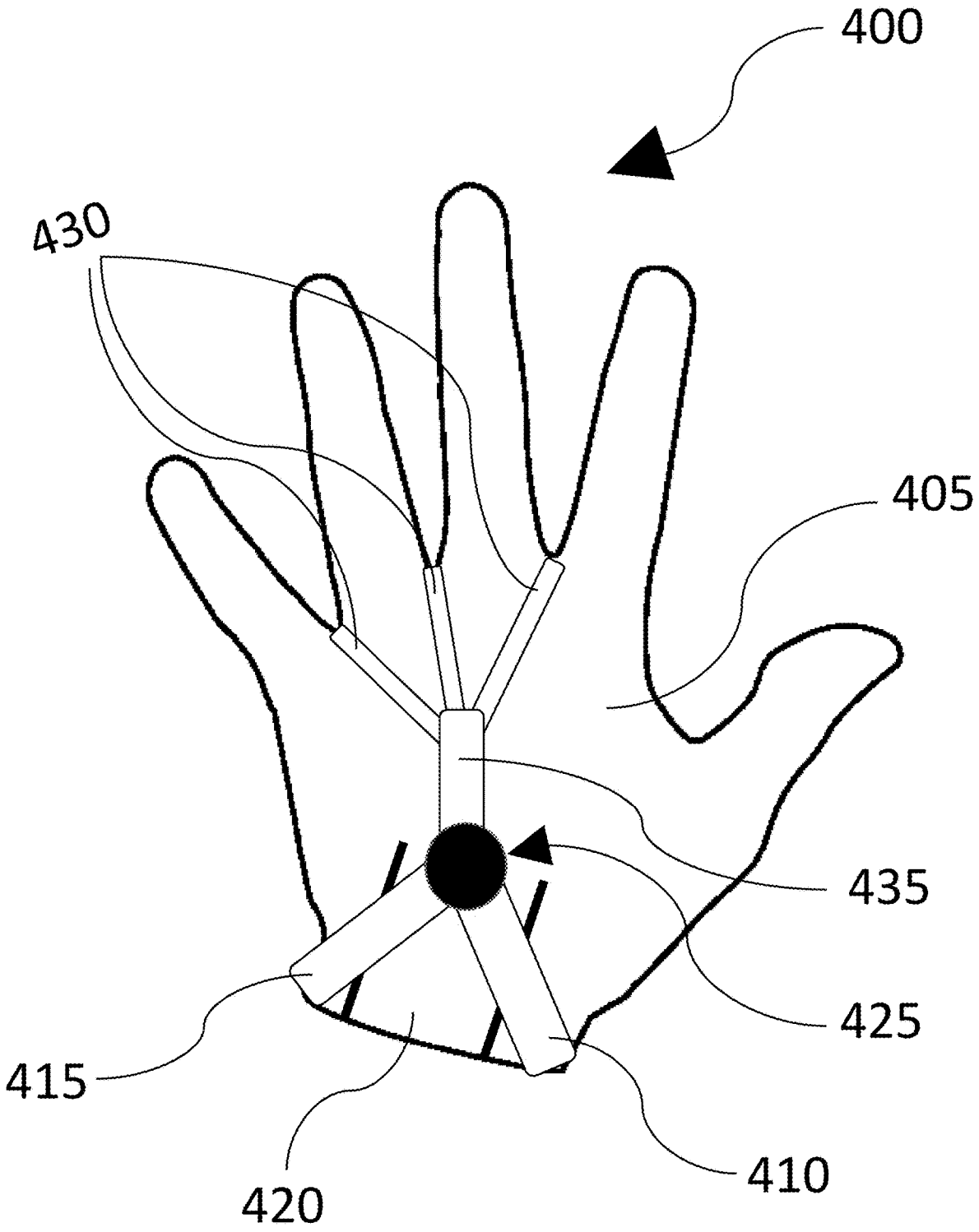
Figure 4C:
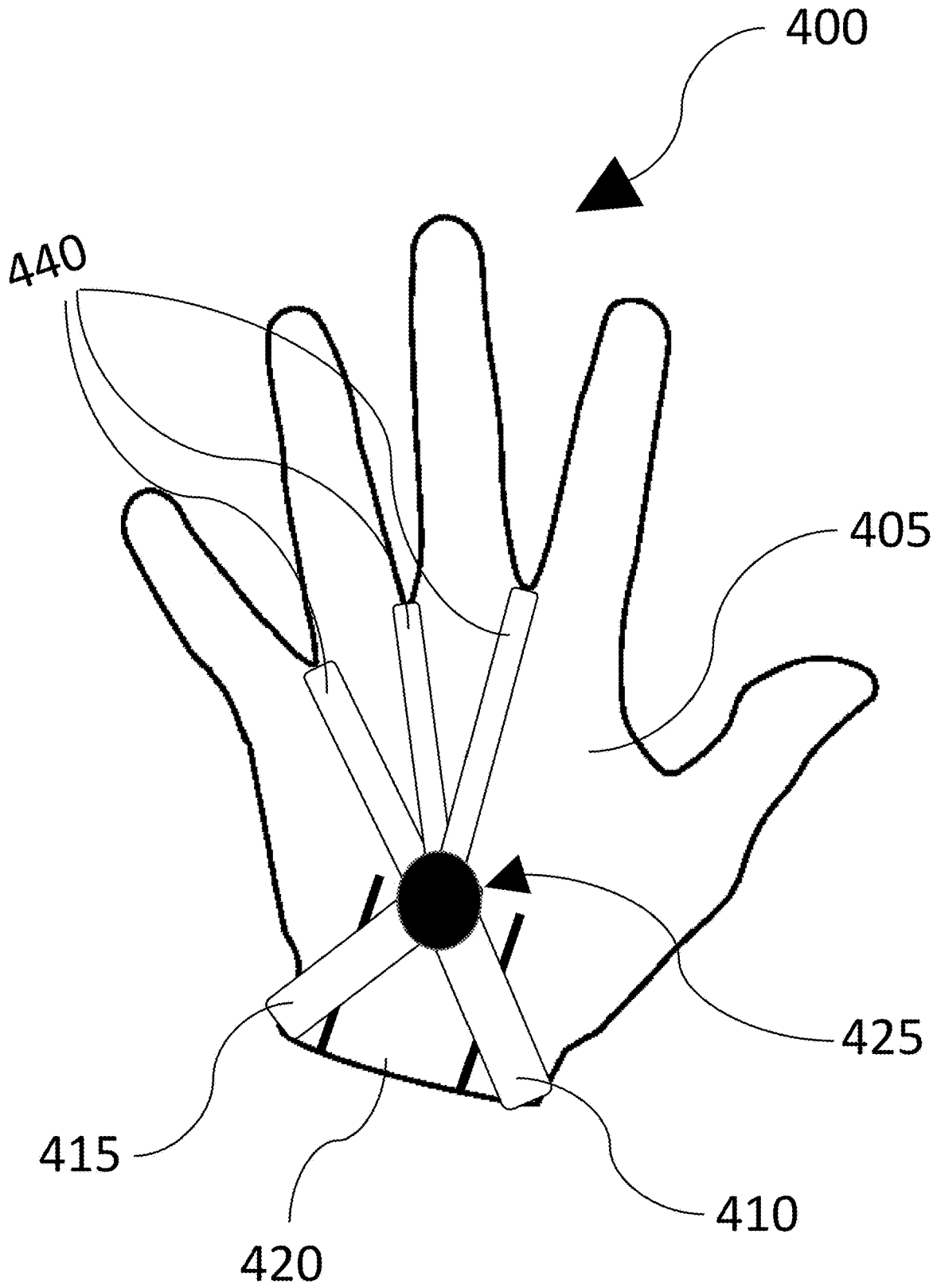

FIGS. 4A-4C depict the dorsal side of the glove for various embodiments of the present invention utilizing a ratchet wheel for creating a secure and customized fit of a glove to the user's hand. FIG. 4A depicts an embodiment of the invention comprising a glove 400 showing the dorsal side 405 of the glove with medial and lateral strap elements 410, 415 extending from the volar side (not shown) of the glove 400 in the manner described above and in relation to other embodiments in the figures. The medial and lateral strap elements 410, 415 extend from the palmar or volar side, around their respective metacarpal bones or regions of the user's hand, and traverse the dorsal side to substantially the center, where they enter and engage with a ratchet wheel 425. In the depicted embodiment, the dorsal side 405 of the glove 400 comprises a tongue 420. The tongue 420 may be a section of the dorsal side 405 of the glove 400 that is created by effectively cutting or otherwise separating and differentiating a portion of the dorsal side 405 of the glove 400. Alternatively, the tongue 420 may be a separate piece or element of material that is attached to, affixed to, or integrated into the dorsal side 405 of the glove 400. The tongue 420 preferably operates partially in a similar manner to the tongue of a shoe in that it provides a basis of support for the medial and lateral strap elements 410, 415 to maintain the secure fit of the glove 400 to the user's hand (not shown). In the depicted embodiment, the medial and lateral strap elements 410, 415 are drawn into the ratchet wheel 425 as the ratchet wheel is rotated, and thus are tightened against the user's hand, thereby applying pressure along their length, and consequently applying pressure to the tongue 420 as well such that said strap elements and the tongue 420 apply pressure and securely fit the glove 400 to the user's hand (not shown). The ratchet wheel 425 is preferably adapted to allow the user to easily tighten the medial and lateral straps 410, 415, as well as to loosen them. The medial and lateral straps 410, 415 preferably remain affixed or attached within the ratchet wheel 425 enabling the glove 400 to be readily donned and doffed by the user without requiring steps to insert the straps 410, 415 into the ratchet wheel 425 and find purchase so that the ratchet wheel 425 can draw the straps 410, 415 in when rotated. Alternatively, the straps 410, 415 may be removably inserted into the ratchet wheel 425 to enable the user to move the straps 410, 415 out of the way when donning or doffing the glove 400. When the straps 410, 415 are tightened via the ratchet wheel 425, it has the effect of tightening both the palmar (not shown) and dorsal 405 sides of the glove 400 against the user's hand, thus providing a secure and customize fit.

FIG. 4B depicts an embodiment of the invention comprising a glove 400 showing the dorsal side 405 of the glove with medial and lateral strap elements 410, 415 extending from the volar side (not shown) of the glove 400 in the manner described above and in relation to other embodiments in the figures. The medial and lateral strap elements 410, 415 extend from the palmar or volar side, around their respective metacarpal bones or regions of the user's hand, and traverse the dorsal side to substantially the center, where they enter and engage with a ratchet wheel 425. In the depicted embodiment, the dorsal side 405 of the glove 400 comprises a tongue 420 that is the same or similar to that depicted and described in FIG. 4A. In the depicted embodiment, the medial and lateral strap elements 410, 415 are drawn into the ratchet wheel 425 as the ratchet wheel is rotated, and thus are tightened against the user's hand, thereby applying pressure along their length, and consequently applying pressure to the tongue 420 as well such that said strap elements and the tongue 420 apply pressure and securely fit the glove 400 to the user's hand (not shown). The ratchet wheel 425 is preferably adapted for to allow the user to easily tighten the medial and lateral straps 410, 415, as well as to loosen them. The medial and lateral straps 410, 415 preferably remain affixed or attached within the ratchet wheel 425 enabling the glove 400 to be readily donned and doffed by the user without requiring steps to insert the straps 410, 415 into the ratchet wheel 425 and find purchase so that the ratchet wheel 425 can draw the straps 410, 415 in when rotated. Alternatively, the straps 410, 415 may be removably inserted into the ratchet wheel 425 to enable the user to move the straps 410, 415 out of the way when donning or doffing the glove 400. When the straps 410, 415 are tightened via the ratchet wheel 425, it has the effect of tightening both the palmar (not shown) and dorsal 405 sides of the glove 400 against the user's hand, thus providing a secure and customized fit. The depicted embodiment includes an additional fit-customization feature in the form of tension straps 430 that extend substantially from at least one of the finger-web areas of the glove 400 to substantially near the tongue 420 or into the ratchet wheel 425. More preferably, at least two tension straps 430 extend substantially from at least two of the finger-web areas of the glove 400 to substantially near the tongue 420 or into the ratchet wheel 425. Still more preferably, at least three tension straps 430 extend substantially from at least three of the finger-web areas of the glove 400 to substantially near the tongue 420 or into the ratchet wheel 425. Optionally, a common tension strap 435 may connect each of the individual tensions straps 430 and then the common tension strap may extend substantially from the point at which it connects and combines the individual tension straps 430 to substantially near the tongue 420 or into the ratchet wheel 425. The process of donning the glove 400 typically involves the user pulling the tongue 420 proximally when attempting to fit the glove 400 to his or her hand. Thus, for embodiments wherein the tension straps 430 or the common tension strap 435 attach substantially near the tongue 420, when the user pulls the tongue 420 proximally, the tension strap(s) 430 that connect substantially near the tongue 420 are similarly pulled proximally along with the tongue 420, and thus tighten the web-portion of the glove to which each extends, into the actual web of the user's hand. In the optional embodiment with a common tension strap 435, pulling the tongue 420 would then pull the common tension strap 435, which then in turn would pull the individual tension straps 430 and tighten the finger web-portion of the glove 400 to the user's hand. Similarly, if the tension strap(s) 430 are attached to or inserted into the ratchet wheel 425, then as the ratchet wheel is rotated it draws in the tension straps 430 (along with the medial and lateral straps 410, 435) and tightens the web portions of the glove 400 against the user's hand. Also similarly, if a common tension strap 435 connects multiple individual tension straps 430, the common tension strap 435 is then attached to are inserted into the ratchet wheel 425 such that when the ratchet wheel is rotated, it draws in the common tension strap 435 which in turn pulls the individual tension strap(s) 430, tightening the web portions of the glove against the user's hand. In other words, if there is a tension strap 430 that ends substantially near the web-portion of the glove that corresponds to the junction of the user's ring and middle fingers, then when the user pulls the tongue proximally while donning the glove, or rotates the ratchet wheel 425 to tighten the attached straps, the tension strap pulls that corresponding web portion of the glove tighter into the web of the user's hand between the ring and middle fingers. Thus, when the tensions strap(s) 430, 435 are used in combination with the medial and lateral strap elements 410, 415, the present invention serves to provide multiple dimensions and directions of tightening and securing of the glove 400 to the user's hand by tightening the glove 400 against both the volar and dorsal surfaces of the user's hand, as well as proximally with specific respect to the points between the user's fingers, which serves to create a custom fit of the glove 400 to the multiple portions of the user's hand.

FIG. 4C depicts an embodiment of the invention comprising a glove 400 showing the dorsal side 405 of the glove with medial and lateral strap elements 410, 415 extending from the volar side (not shown) of the glove 400 in the manner described above and in relation to other embodiments in the figures. The medial and lateral strap elements 410, 415 extend from the palmar or volar side, around their respective metacarpal bones or regions of the user's hand, and traverse the dorsal side to substantially the center, where they enter and engage with a ratchet wheel 425. In the depicted embodiment, the dorsal side 405 of the glove 400 comprises a tongue 420 that is the same or similar to that depicted and described in FIG. 4A. In the depicted embodiment, the medial and lateral strap elements 410, 415 are drawn into the ratchet wheel 425 as the ratchet wheel is rotated, and thus are tightened against the user's hand, thereby applying pressure along their length, and consequently applying pressure to the tongue 420 as well such that said strap elements and the tongue 420 apply pressure and securely fit the glove 400 to the user's hand (not shown). The ratchet wheel 425 is preferably adapted for to allow the user to easily tighten the medial and lateral straps 410, 415, as well as to loosen them. The medial and lateral straps 410, 415 preferably remain affixed or attached within the ratchet wheel 425 enabling the glove 400 to be readily donned and doffed by the user without requiring steps to insert the straps 410, 415 into the ratchet wheel 425 and find purchase so that the ratchet wheel 425 can draw the straps 410, 415 in when rotated. Alternatively, the straps 410, 415 may be removably inserted into the ratchet wheel 425 to enable the user to move the straps 410, 415 out of the way when donning or doffing the glove 400. When the straps 410, 415 are tightened via the ratchet wheel 425, it has the effect of tightening both the palmar (not shown) and dorsal 405 sides of the glove 400 against the user's hand, thus providing a secure and customized fit. The depicted embodiment includes an additional fit-customization feature in the form of tension straps 440 that extend substantially from at least one of the finger-web areas of the glove 400 to substantially near the tongue 420 or into the ratchet wheel 425. More preferably, at least two tension straps 440 extend substantially from at least two of the finger-web areas of the glove 400 to substantially near the tongue 420 or into the ratchet wheel 425. Still more preferably, at least three tension straps 440 extend substantially from at least three of the finger-web areas of the glove 400 to substantially near the tongue 420 or into the ratchet wheel 425. The process of donning the glove 400 typically involves the user pulling the tongue 420 proximally when attempting to fit the glove 400 to his or her hand. Thus, for embodiments wherein the tension straps 440 attach substantially near the tongue 420, when the user pulls the tongue 420 proximally, the tension strap(s) 440 that connect substantially near the tongue 420 are similarly pulled proximally along with the tongue 420, and thus tighten the web-portion of the glove to which each extends into the actual web of the user's hand. Similarly, if the tension strap(s) 440 are attached to or inserted into the ratchet wheel 425, then as the ratchet wheel is rotated it draws in the tension straps 440 (along with the medial and lateral straps 410, 415) and tightens the web portions of the glove 400 against the user's hand. In other words, if there is a tension strap 440 that ends substantially near the web-portion of the glove that corresponds to the junction of the user's ring and middle fingers, then when the user pulls the tongue proximally while donning the glove, or rotates the ratchet wheel 425 to tighten the attached straps, the tension strap pulls that corresponding web portion of the glove tighter into the web of the user's hand between the ring and middle fingers. Thus, when the tension strap(s) 440 are used in combination with the medial and lateral strap elements 410, 415, the present invention serves to provide multiple dimensions and directions of tightening and securing of the glove 400 to the user's hand by tightening the glove 400 against both the volar and dorsal surfaces of the user's hand, as well as proximally with specific respect to the points between the user's fingers, which serves to create a custom fit of the glove 400 to the multiple portions of the user's hand.

Figure 5:
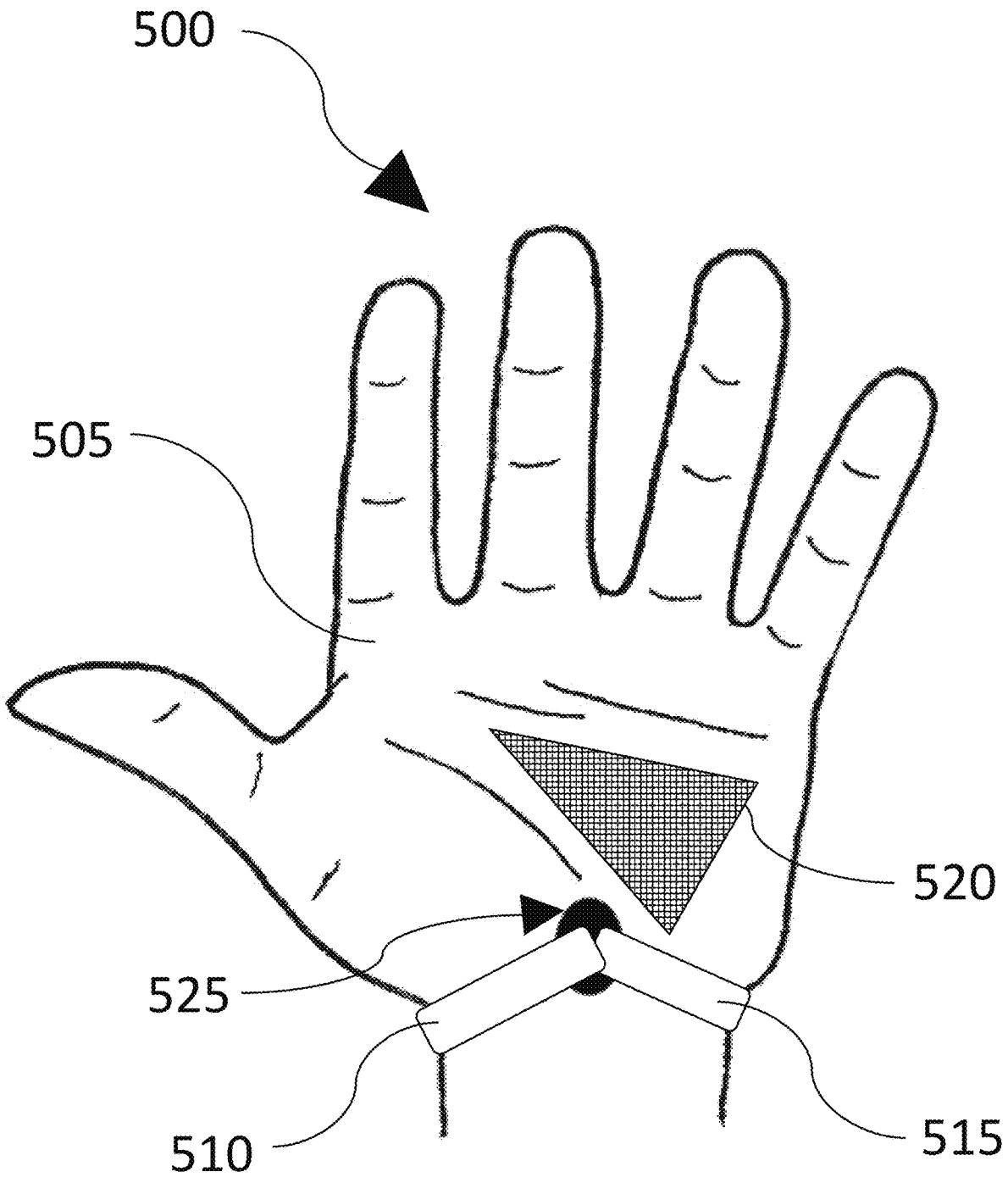
FIG. 5. A picture depicting a glove embodiment of the present invention wherein the palmar side of the glove comprises at least in part a flexible mesh material adapted for breathability, flexibility, and enhanced secure fit to the palm of the user's hand.

FIG. 5 is a picture depicting a glove embodiment of the present invention wherein the palmar side of the glove comprises at least in part a flexible mesh material 520 adapted for breathability, flexibility, and enhanced secure fit to the palm of the user's hand. The picture depicts a left-hand glove 500 with the palmar or volar side 505 visible. A common strap connection point 525 is located proximally on the palm of the glove 500. The common strap connection point 525 may be a single point on the volar side 505 of the glove 500 to which medial and lateral strap elements 510, 515 connect. The common strap connection point 525 preferably comprises an additional support element (not shown) in order to strengthen and secure the connection of the medial and lateral strap elements 510, 515 to the glove 500. The support element (not shown) of the common strap connection point 525 may comprise a separate and distinct element or feature attached to, affixed to, or integrated into the volar side 505 of the glove 500. The support element (not shown) may comprise a section or portion of material integrated into the volar side 505 of the glove 500, where the support element material has a higher tensile strength compared to the material of which the majority of the glove 500, such that the support element effectively replaces the section of the volar side 505 of the glove 500, at the location of the common strap connection point 525. For example, the majority of the glove may be constructed of a strong yet comfortable material, for example cabretta leather, whereas at the location of the common strap connection point 525, a section of material with a higher tensile strength, such as kangaroo leather or Kevlar. Alternatively, the support element (not shown) may be an additional element or material integrated into the overall glove 500 material, for example as a middle layer between an inner and outer layer of the glove 500. Regardless of the support element's (not shown) nature, the medial and lateral strap elements 510, 515 attach thereto and are effectively anchored to that common strap connection point 525 on the volar side 505 of the glove 500. Thus, not only does the common strap connection point 525 anchor the medial and lateral strap elements 510, 515, but as the medial and lateral strap elements 510, 515 are pulled and tightened the glove 500 is pulled taught and tightened against the webbed portions of the wearer's fingers. The common strap connection point 525 may be a substantially centralized location on the volar side 505 of the glove 500, though the general location of the common strap connection point 525 need not be any specific location other than on the volar side 505 of the glove 500. The common strap connection point may be, substantially literally, a point on the volar side 505 of the glove 500 to which both medial and lateral strap elements 510, 515 connect with the glove 500 and each other. Alternatively, the common strap connection point 525 may be a general region or area on the volar side 505 of the glove 500, such as an area or region defined by the support element (not shown). In this alternative embodiment, the medial and lateral strap elements 510, 515 need not actually connect with each other. In still other alternative embodiments, a common strap connection point 525 may not be used, and instead each of the medial and lateral strap elements 510, 515 may connect to a separate strap connection point (effectively separate medial and lateral strap connections points), each preferably supported or reinforced as described above. In still further embodiments, the strap connection point(s) 525 and/or support element (not shown) may be made of elastic material that provides the same function as a more rigid or tensile material, but allows for additional flexibility during use of the glove to allow the straps and/or volar side 505 of the glove 500 to flex and move along with the user's hand. The medial strap element 515 preferably extends from the common strap connection point 525 or the medial strap connection point (not shown) and is adapted to wrap around the base of the $5^{th}$ metacarpal. The lateral strap element 510 preferably extends from the common strap connection point 525 or the lateral strap connection point (not shown) and wrap around the base of the $1^{st}$ metacarpal. When both straps have tension they will tighten the glove onto the wearer's hand by pulling the common strap connection point 525 or separate medial and lateral connection points (not shown) proximally. This tension simultaneously draws the fingers of the glove 500 proximally and allows the medial and lateral strap elements 510, 515 to be drawn around the respective metacarpal bones securing the glove securely to the wearer's hand. The depicted embodiment further comprises a volar or palmar side 505 that is constructed at least in part of a mesh material 520 that is flexible and breathable. Preferably, the mesh material 520 is made from a material that exhibits high tensile strength and elasticity in each fiber of the mesh. The main benefit of the mesh material 520, as provided by the strong, elastic fibers comprised in the mesh material, is the close fit provided to the palmar side of the user's hand. The elastic mesh material 520 allows the palmar side 505 of the glove 500 to stay on close contact with the palm of the user's hand. Often with many gloves, as the user moves his or her hand, for example gripping and releasing with the fingers and such hand movements, the palm of the glove moves, tents, bunches or otherwise pulls away from contact with the user's palm and moves into potentially uncomfortable positions. Additionally, the palm of such gloves moving out of place can affect the activity the user is performing. For example, in a golf glove, if the palm material moves or bunches during the user's swing, it can cause the user's grip on the golf club to slip or to be misaligned. The flexible, elastic mesh material of the present invention helps maintain the fit and position of the palmar side of the glove against the user's palm, and thus minimizes the movement or displacement of the glove material.

It will be apparent to those skilled in the art that various modifications and variations can be made to the present invention without departing from the spirit and scope of the invention. Thus, it is intended that the present invention cover the various modifications and variations of this invention provided they come within the scope of the appended claims and their equivalents.

The invention claimed is:

1. A glove or handwear comprising:

a. a dorsal side, a volar side, a medial side, a lateral side, a distal side, and a proximal side, the dorsal side comprising at least one dorsal connection element, and the volar side comprising a common strap connection point located proximally from the center of the volar side of the glove or handwear and having an area of 3 $cm^2$, 1 $cm^2$, 0.5 $cm^2$, or 0.1 $cm^2$;

b. at least one medial connecting strap element connected to the common strap connection point located on the volar side of the glove or handwear, the at least one medial connecting strap element adapted to extend from the common strap connection point, substantially proximal and wrap around dorsally the proximal end of at least the fifth metacarpal, and to extend substantially laterally over the dorsal side of the glove or handwear; and c. at least one lateral connecting strap element connected to the common strap connection point located on the volar side of the glove or handwear, the at least one lateral connecting strap element adapted to extend from the common strap connection point substantially proximal and wrap around dorsally the proximal end of at least the first metacarpal, and to extend substantially medially over the dorsal side of the glove or handwear;

d. wherein the at least one medial connecting strap element is further adapted to avoid the distal end of the ulna and the at least one lateral connecting strap is further adapted to avoid the distal end of the radius, the at least one medial and lateral connecting strap elements are adapted to attach to each other and to the at least one dorsal connection element, and the common strap connection point is adapted to at least in part anchor the at least one medial and lateral connecting strap elements to the glove or handwear and to each other as well as to provide a focal point to which the glove or handwear is pulled tight against valleys between fingers of the glove or handwear as the at least one medial and lateral connection strap elements are wrapped around a user's hand and connected to the at least one dorsal connection element.

2. The glove or handwear of claim 1, wherein the volar side of the glove or handwear comprises a flexible elastic material adapted to naturally provide flexion of the fingers on the volar side the glove or handwear, and wherein extension of the fingers extends and tightens the flexible elastic material against the palm of the user's hand.

3. The glove or handwear of claim 1, wherein the at least one dorsal connection element is a buckle.

4. The glove or handwear of claim 1, further comprising at least one finger tension strap extending proximally from at least one valley to the at least one dorsal connection element.

5. The glove or handwear of claim 4, further comprising a tongue on the dorsal side and the at least one dorsal connection element is attached to, integrated into, or otherwise disposed on the tongue.

6. The glove or handwear of claim 5, comprising finger tensions straps for each valley of the glove or handwear.

7. The glove or handwear of claim 6, wherein the finger tension straps are adapted to be drawn proximally as the at least one medial and lateral connection strap elements are wrapped around the user's hand and connected to the at least one dorsal connection element.

8. The glove or handwear of claim 7, further comprising a flexible elastic material on the volar side that is a mesh material adapted to be breathable and flexible so as to conform to a palm of the user's hand.

9. A glove or handwear comprising:

a. a dorsal side, a volar side, a medial side, a lateral side, a distal side, and a proximal side, the dorsal side comprising at least one dorsal connection element, the volar side of the glove or handwear comprising a common strap connection point located proximally from the center of the volar side of the glove or handwear and having an area of 3 $cm^2$, 1 $cm^2$, 0.5 $cm^2$, or 0.1 $cm^2$ and a flexible elastic material adapted to naturally provide flexion of fingers on the volar side the glove or handwear, and wherein extension of the fingers extends and tightens the flexible elastic material against the palm of a wearer's hand;

b. at least one medial connecting strap element connected to the common strap connection point located on the volar side of the glove or handwear, the at least one medial connecting strap element adapted to extend from the common strap connection point, substantially proximal and wrap around dorsally the proximal end of at least the fifth metacarpal, and to extend substantially laterally over the dorsal side of the glove or handwear; and c. at least one lateral connecting strap element connected to the common strap connection point located on the volar side of the glove or handwear, the at least one lateral connecting strap element adapted to extend from the common strap connection point substantially proximal and wrap around dorsally the proximal end of at least the first metacarpal, and to extend substantially medially over the dorsal side of the glove or handwear;

d. wherein the at least one medial connecting strap element is further adapted to avoid the distal end of the ulna and the at least one lateral connecting strap is further adapted to avoid the distal end of the radius, and the at least one medial and lateral connecting strap elements are adapted to attach to each other and to the at least one dorsal connection element, and the common strap connection point is adapted to at least in part anchor the at least one medial and lateral connecting strap elements to the glove or handwear and to each other as well as to provide a focal point to which the glove or handwear is pulled tight against valleys between fingers of the glove or handwear as the at least one medial and lateral connection strap elements are wrapped around a user's hand and connected to the at least one dorsal connection element.

10. The glove or handwear of claim 9, wherein the at least one dorsal connection element is a buckle.

11. The glove or handwear of claim 9, further comprising at least one finger tension strap extending proximally from at least one valley to the at least one dorsal connection element.

12. The glove or handwear of claim 11, further comprising a tongue on the dorsal side and the at least one dorsal connection element is attached to, integrated into, or otherwise disposed on the tongue.

13. The glove or handwear of claim 12, wherein the finger tension straps are adapted to be drawn proximally as the at least one medial and lateral connection strap elements are wrapped around the user's hand and connected to the at least one dorsal connection element.

14. The glove or handwear of claim 9, wherein the volar side comprises a mesh material adapted to be breathable and flexible so as to conform to a palm of the user's hand.

15. A glove or handwear comprising:

a. a dorsal side, a volar side, a medial side, a lateral side, a distal side, and a proximal side, the dorsal side comprising at least one dorsal connection element, and the volar side comprising a common strap connection point located proximally from the center of the volar side of the glove or handwear and having an area of 3 $cm^2$, 1 $cm^2$, 0.5 $cm^2$, or 0.1 $cm^2$ and being a discernible point of attachment to the volar side of the glove or handwear;

b. at least one medial connecting strap element connected to the common strap connection point located on the volar side of the glove or handwear, the at least one medial connecting strap element adapted to attach to and extend from the common strap connection point, substantially proximal and wrap around dorsally the proximal end of at least the fifth metacarpal, and to extend substantially laterally over the dorsal side of the glove or handwear; and c. at least one lateral connecting strap element connected to the common strap connection point located on the volar side of the glove or handwear, the at least one lateral connecting strap element adapted to attach to and extend from the common strap connection point substantially proximal and wrap around dorsally the proximal end of at least the first metacarpal, and to extend substantially medially over the dorsal side of the glove or handwear;

d. wherein the at least one medial connecting strap element is further adapted to avoid the distal end of the ulna and the at least one lateral connecting strap is further adapted to avoid the distal end of the radius, the at least one medial and lateral connecting strap elements are adapted to attach each other and to the at least one dorsal connection element, and the common strap connection point is adapted to at least in part anchor the at least one medial and lateral connecting strap elements to the glove or handwear and to each other as well as to provide a focal point to which the glove or handwear is pulled tight against valleys between fingers of the glove or handwear as the medial and lateral connection strap elements are wrapped around a user's hand and connected to the at least one dorsal connection element.

16. The glove or handwear of claim 15, wherein the at least one dorsal connection element is a buckle.

17. The glove or handwear of claim 16, further comprising at least one finger tension strap extending proximally from at least one valley to the dorsal connection element.

18. The glove or handwear of claim 17, further comprising a tongue on the dorsal side and the at least one dorsal connection element is attached to, integrated into, or otherwise disposed on the tongue.

19. The glove or handwear of claim 18, wherein the finger tension straps are adapted to be drawn proximally as the at least one medial and lateral connection strap elements are wrapped around the user's hand and connected to the at least one dorsal connection element.

20. The glove or handwear of claim 15, further comprising a flexible elastic material on the volar side that is a mesh material adapted to be breathable and flexible so as to conform to a palm of the wearer's hand.

* * * * *